US006856308B2

(12) United States Patent
Akimoto et al.

(10) Patent No.: US 6,856,308 B2
(45) Date of Patent: Feb. 15, 2005

(54) IMAGE DISPLAY APPARATUS

(75) Inventors: Hajime Akimoto, Oume (JP); Yoshiro Mikami, Hitachiota (JP); Toshio Miyazawa, Chiba (JP)

(73) Assignee: Hitachi, Ltd., Tokyo (JP)

( * ) Notice: Subject to any disclaimer, the term of this patent is extended or adjusted under 35 U.S.C. 154(b) by 288 days.

(21) Appl. No.: 09/888,644

(22) Filed: Jun. 26, 2001

(65) Prior Publication Data

US 2002/0000970 A1 Jan. 3, 2002

(30) Foreign Application Priority Data

Jun. 29, 2000 (JP) ..... 2000-201442

(51) Int. Cl.[7] ..... G09G 3/36
(52) U.S. Cl. ..... 345/98; 345/100; 345/211
(58) Field of Search ..... 345/98, 87, 100, 345/211, 204, 205, 690, 88, 89, 92, 96, 99, 102, 209

(56) References Cited

U.S. PATENT DOCUMENTS 5,648,791 A * 7/1997 Date et al. ..... 345/89
5,907,314 A * 5/1999 Negishi et al. ..... 345/103
6,049,321 A * 4/2000 Sasaki ..... 345/99
6,157,358 A * 12/2000 Nakajima et al. ..... 345/96
6,304,241 B1 * 10/2001 Udo et al. ..... 345/96
6,344,814 B1 * 2/2002 Lin et al. ..... 341/144
6,373,459 B1 * 4/2002 Jeong ..... 345/100
6,411,273 B1 * 6/2002 Nakamura et al. ..... 345/98
6,552,704 B1 * 4/2003 Zavracky et al. ..... 345/88

* cited by examiner

*Primary Examiner*—Regina Liang
*Assistant Examiner*—Jennifer T. Nguyen
(74) *Attorney, Agent, or Firm*—Antonelli, Terry, Stout & Kraus, LLP

(57) ABSTRACT

An image display apparatus having a display unit composed of a plurality of pixels and a control unit for controlling the display unit. The image display apparatus further includes a DA converter for converting digital display data into an analog image signal, wherein the DA converter is composed of a first DA converter and a second DA converter, the power consumption when the first DA converter is operated being smaller than that when the second DA converter is operated. Either of the first DA converter or the second DA converter are operated according to an instruction from the control unit, and the converted analog image signal is outputted to the display unit. The display unit changes the number of the independent display pixels of said display unit according to the instruction from the control unit and displays an image according to the analog image signal.

26 Claims, 20 Drawing Sheets

IMAGE DISPLAY APPARATUS

BACKGROUND OF THE INVENTION

The present invention relates to a liquid crystal image display apparatus which can display an image with a low power consumption.

Hereafter, an example of a display apparatus will be explained with reference to FIG. 23, which shows the configuration of the conventional TFT liquid crystal display apparatus. A typical display pixel 200 has a liquid crystal capacity 201 and a pixel switch 202, and the pixels are arranged in the form of a matrix. The gate of each pixel switch 202 is connected to gate line shift register 204 through a gate line 203. Moreover, in each pixel, one end of pixel switch 202 is connected to one of the DA converters 206A, 206B through a signal line 205. A line memory 207A, 207B is connected to a DA converter 206A, 206B, and the display data on input line209A, 209B is applied under control of the shift register 208A, 208B to the line memory 207A, 207B. Each of the above-mentioned circuit parts is formed on the same substrate by using polysilicon TFT.

In this arrangement, a separate pixel drive circuit composed of a DA converter 206, a line memory 207 and a shift register 208, as shown in the figure, has been provided above and below the pixel area; for instance, a signal line 205 of an odd number row is connected to an upper driving circuit and signal line 205 of an even number row is connected to a lower driving circuit.

Next, the operation of the apparatus of FIG. 23 will be explained.

The digital display data is input in series through the display data input lines 209A, 209B to the shift registers 208A, 208B and is written in the line memories 207A, 207B one by one by the shift registers 208A, 208B. Next, the display data stored in the line memories 207A, 207B is input to the DA converters 206A, 206B in parallel. The DA converters 206A, 206B output this data on signal lines 205 as a voltage of an analog image signal. At this time, when pixel switch 202 of a fixed display pixel line 203 selected by gate line shift register 204 turns on, the voltage of an analog image signal is written in the capacity 201 of the liquid crystal of the selected display pixels. This TFT liquid crystal panel displays the image based on the input display data according to the operation described above. Signal line 205 of the odd number row is connected to an upper driving circuit, and signal line 205 of the even number row is connected to a lower driving circuit, as described above. Therefore, the upper and lower driving circuits are synchronously driven, and the display of one screen is allotted to the upper and lower driving circuits.

Here, because the upper and lower circuits operate to drive a pixel under the same condition, both have basically the same circuit structures. An example of this display apparatus is described in detail in ISSCC (International Solid-State Circuits Conference) 2000, Digest of technical papers, pp.188–189.

The demand for installation of a high-definition image display panel which uses a number of pixels exceeding that of QCIF (Quarter common intermediate format 144 176 pixels) and CIF (288 352 pixels) for a portable information device along with the practical use of IMT-2000 (international Mobile Telecommunications 2000) is increasing. There is also a demand for reducing the weight of a portable information device by reducing the weight of the secondary cell in one side. The demand for producing an image display unit having a low power consumption also has strengthened day by day at the same time.

On the other hand, it has been very difficult to realize a display image of high definition and low power consumption at the same time by using the above-mentioned conventional techniques. The reason is that the operation frequency of the liquid crystal panel increases and power consumption increases inevitably if a high definition display image is produced by an increase in the number of pixels.

SUMMARY OF THE INVENTION

An object of the present invention is to provide an image display apparatus having a low power consumption.

Another object of the present invention is to provide an image display apparatus in which both a low power consumption and generation of a high-definition image are possible.

According to one aspect of the present invention, an image display apparatus is provided which has the following configuration. That is, the image display apparatus has a display unit composed of a plurality of pixels and a control unit for controlling the display unit. It further includes a DA converter for converting digital display data into an analog image signal, wherein said DA converter is composed of a first DA converter and a second DA converter, the power consumption when said first DA converter is operated being smaller than that when said second DA converter is operated. In accordance with the invention, either of said first DA converter and said second DA converter are operated according to an instruction from said control unit, and the converted analog image signal is outputted to said display unit, wherein said display unit changes the number of the independent display pixels of said display unit, according to the instruction from said control unit, and generates a display according to said analog image signal.

According to another aspect of the present invention, an image display apparatus is provided which has the following configuration. That is, the image display apparatus has a display unit composed of plural pixels and a control unit for controlling the display unit. The image display apparatus further includes a DA converter for converting digital display data into an analog image signal, wherein said DA converter includes a first DA converter and a second DA converter, and wherein said first DA converter and said second DA converter each convert the digital display data into an analog image signal with a different number of bits, respectively.

According to a further aspect of the present invention, an image display apparatus is provided which has the following configuration. That is, the image display apparatus has a display unit composed of plural pixel, and a control unit for controlling the display unit. The image display apparatus further includes a DA converter for converting digital display data into an analog image signal, wherein said DA converter includes a first DA converter and a second DA converter, and wherein said first DA converter and said second DA converter each convert the digital display data into an analog image signal with a different frame frequency, respectively.

DETAILED DESCRIPTION OF THE PREFERRED EMBODIMENTS

The present invention will be explained in conjunction with the following embodiments.

(First Embodiment)

A first embodiment of the present invention will be explained with reference to FIG. 1–FIG. 12. The overall configuration of this embodiment will be considered first.

Figure 1:
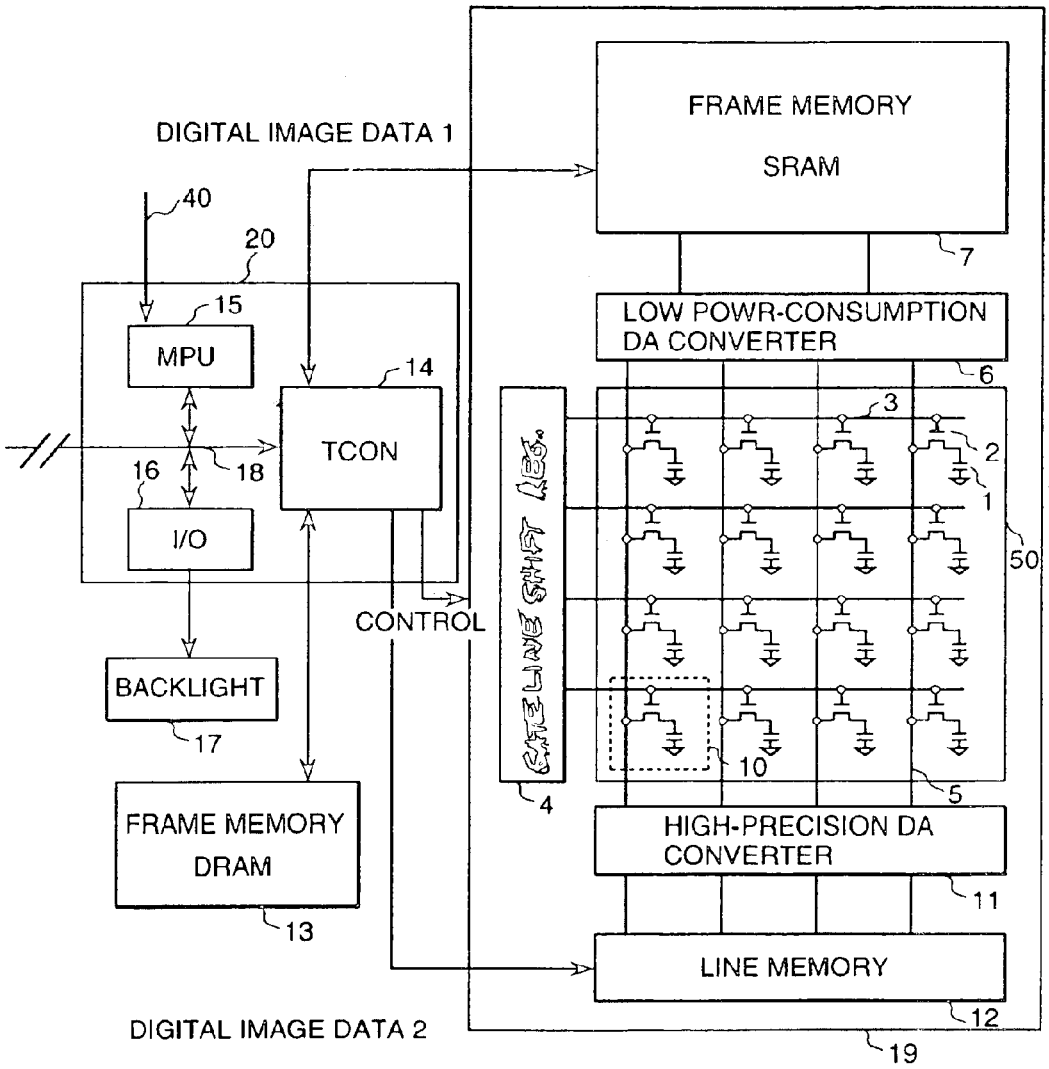
FIG. 1 is a schematic diagram which shows the configuration of the liquid crystal display apparatus according to a first embodiment of the present invention.

FIG. 1 shows the configuration of the polysilicon TFT liquid crystal display apparatus according to this embodiment. Display unit 50 is composed of a plurality of display pixels 10 arranged in the form of a matrix. Each display pixel 10 has a liquid crystal capacity 1 and a pixel switch 2. The gate of the pixel switch 2 is connected to gate line shift register 4 through a gate line 3. One end of the pixel switch 2 is connected to a low power consumption DA converter 6 and a highly accurate DA converter 11 through a signal line 5. Frame memory 7, composed of a SRAM, is connected to the input of low power consumption DA converter 6. The frame memory 7 is also connected to timing controller (TCON) 14. Because TCON 14 controls the display unit, it is also called a panel controller. The output of a line memory 12 is connected to the input of highly accurate DA converter 11. The input of line memory 12 is connected to TCON 14. TCON 14 is connected to one end of a bus 18 and to a frame memory 13, which is composed of a DRAM. Mainly, main processing unit (MPU) 15, 110 circuit (1/0) 16, etc. are connected to the bus 18. The I/O 16 controls back light unit 17. TCON14, MPU15 and I/O 16 form a control unit 20. Bus 18 may be included in this control unit 20. The components, namely, display pixel 10, gate line shift register 4, low power consumption DA converter 6, frame memory7, highly accurate DA converter 11, and line memory 12, etc. are formed on a single glass substrate 19 by using polysilicon TFT. A control timing signal from TCON 14 is supplied to those components. On the other hand, TCON 14, frame memory 7, MPU 15, and I/O 16, etc. are composed of a single crystal Si-LSI chip. General structures necessary for constructing a color TFT panel, namely, a common electrode of the liquid crystal, a color filter, and a back light configuration etc. are omitted from the drawing for simplification.

Next, the overall operation of this embodiment will be explained. Detailed operation of each part will be described later individually as part of the explanation of an individual component.

MPU 15 transmits the digital image display data to frame memory 7 and frame memory 13 through TCON 14. In addition, MPU 15 controls the pixel drive circuit of the display unit through TCON 14. This embodiment has two display modes, including a low power consumption display mode and a high-definition display mode. When selecting the "Low power consumption display mode", MPU 15 and TCON 14 write data in the panel and read the image display data from frame memory 7 to MPU 15 by entirely using frame memory 7. The image display data written in frame memory 7 is read one by one and is input to low power consumption DA converter 6. The converted signal or analog image signal is written in the capacity 1 of the liquid crystal of each pixel selected by the gate line shift register 4. The highly accurate DA converter 11, line memory 12, DRAM or frame memory 13, etc. are not driven in this "Low power consumption display mode". Therefore, it is clear that those units of the equipment do not consume the electric power. At this time, the driven circuits include frame memory 7 and low power consumption DA converter 6, etc. by which a parallel output and the DA conversion can be performed for each pixel line. Accordingly, the liquid crystal display panel can be driven at a low power consumption by suppressing the drive frequency to a low level.

Next, when the "high-definition display mode" is selected, MPU 15 writes data in the panel and reads the image display data from frame memory 13 to MPU 15 by entirely using frame memory 13. The image display data written in frame memory 13 is read one by one and is input to highly accurate DA converter 11 through TCON 14 and line memory 12. The converted voltage of an analog image signal is written in the capacity 1 of the liquid crystal of pixels selected by the gate line shift register 4. Although the low power consumption DA converter 6 is not driven during this "high-definition display mode", the image display data when the "Low power consumption display mode" is displayed can be saved in frame memory 7. As for frame memory 7, it is not so suitable to design the panel image frame to have a large capacity for the sake of area saving. However, because frame memory 13 is a DRAM-LSI, it is possible to make it to have a large capacity comparatively easily. Therefore, the amount of the pixel data (digital image display data 2) in a high-definition display mode becomes remarkably more than the amount of the pixel data (digital image display data I) in the low power consumption display mode, as will be described later.

Here, MPU 15 controls back light unit 17 through bus 18 and I/O 16. As a rule, a reflection-type liquid crystal display is selected without driving the back light unit during the low power consumption display mode. As a result, the power consumption is decreased. However, a more high-quality, transmission-type liquid crystal image is displayed by driving the back light unit and illuminating the display pixel array from the back thereof during the high-definition display mode. Namely, a low power consumption display mode which uses low power consumption DA converter 6 and a high-definition display mode which uses highly accurate DA converter 11 are used properly in this embodiment. It becomes possible to realize both the provision of a portable information device having a super-low power consumption when standing by and which is capable of displaying an image including a moving image with a high-definition at the same time, by the proper use of the arrangement described above.

These modes can be switched by inputting a switch instruction 40 to MPU 15 in the control unit 20, for example. This switching operation is initiated by the switch instruction given by the user. The component and the operation of each part of this embodiment will be sequentially explained.

Hereafter, the configuration and operation of frame memory 7 will be explained with reference to FIGS. 2 to 5.

Figure 2:
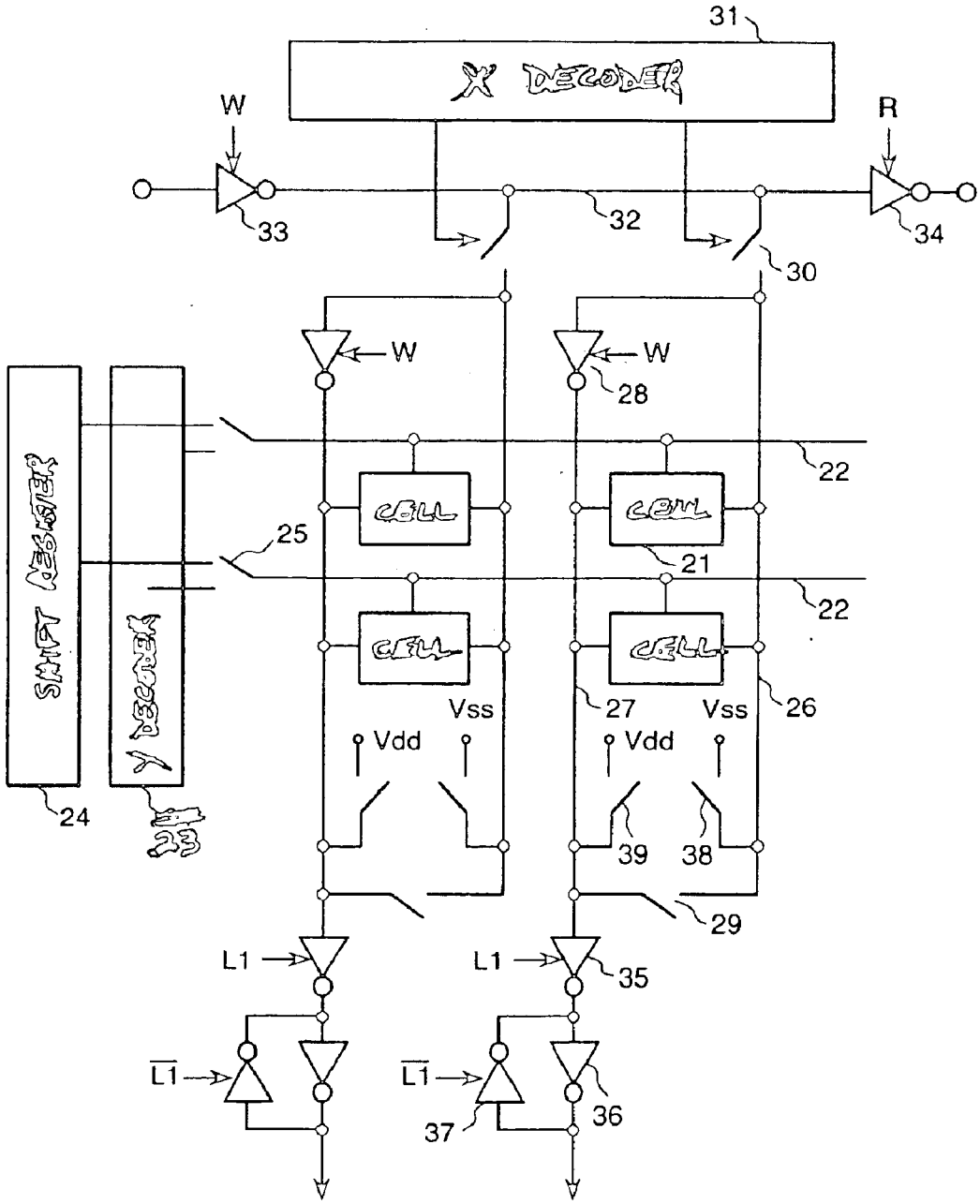
FIG. 2 is a schematic diagram which shows the circuit structure of the frame memory in the first embodiment.

FIG. 2 shows the circuit structure of frame memory 7. The word lines 22 are connected in a line direction to a plurality of SRAM memory cells 21 arranged in the form of a matrix. One end of word line 22 is connected to a word line shift register 24 or Y decoder 23 through word line selection switch 25. Moreover, each memory cell 21 is connected to a data line 26 and an inverse data line 27 in a column direction. Data line reset switch 38 and inverse data line reset switch 39 are provided in data line 26 and inverse data line 27, respectively. In addition, data line short-circuit switch 29 is provided between them. Inverse data line buffer 28, which operates in response to the writing signal (W in Figure), is provided in one end of inverse data line 27, and data line 26 is connected to its input. Data input switch 30 is provided in one end of data line 26, and the other end of data input switch 30 is connected to data input line 32. Data input switch 30 is selected by X decoder 31. Data input buffer 33, which operates in response to the writing signal (W in Figure), and data output buffer 34, which operates in response to the reading signal (R in Figure), are connected to both ends of data input line 32. On the other hand, a one bit memory composed of a data line latch 35, which operates in response to the latch signal (L1 in Figure), inverter 36, and a data line latch 37, which operates in response to the inverse latch signal (L1 bar in Figure), are arranged on the other the other end of inverse data line 27.

Figure 3:
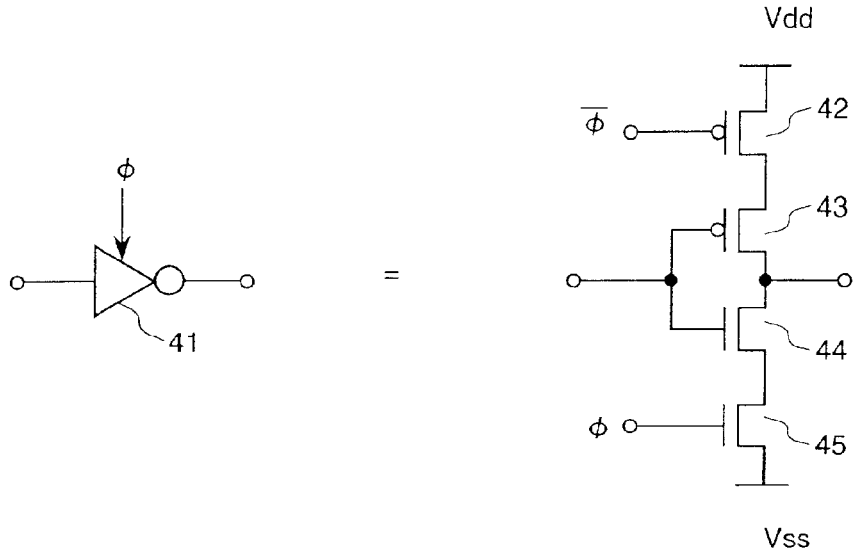
FIG. 3 is a schematic diagram which shows the buffer in the first embodiment or the configuration of the latch circuit.

FIG. 3 shows the buffer of FIG. 2, that is, the circuit structure of latch circuit 41. The buffer, that is, latch circuit 41, is composed of a CMOS clock and an inverter. P-channel polysilicon TFT 42, 43, and n-channel polysilicon TFT 44, 45 are driven by complementary signal pulse. Therefore, three kinds of state-output, including Vdd, Vss which are the output of the inverter, or an output-open are given by selecting the signal pulse.

Figure 4:
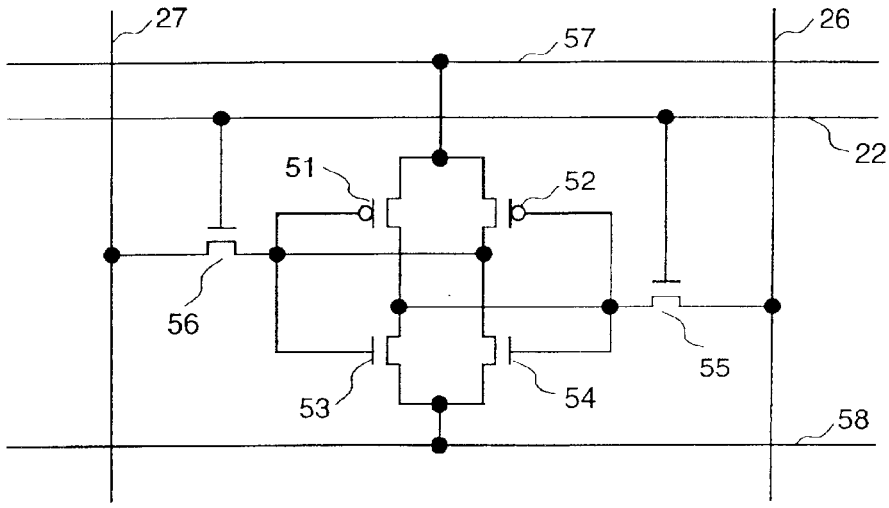
FIG. 4 is a schematic diagram which shows the circuit structure of the SRAM memory cell in the first embodiment.

FIG. 4 shows the circuit structure of SRAM memory cell 21. The main body of the memory cell is a flip-flop composed of p-channel polysilicon TFT 51, 52, and n-channel polysilicon TFT 53 and 54. This circuit is connected to data line 26 and inverse data line 27 through word line switch 55 and inverse word line switch 56 that are controlled by a word line 22. The electric power from high voltage power wire 57 is supplied to the high voltage side of the flip-flop circuit, and the electric power from low voltage power wire 58 is supplied to the low voltage side.

Figure 5A:
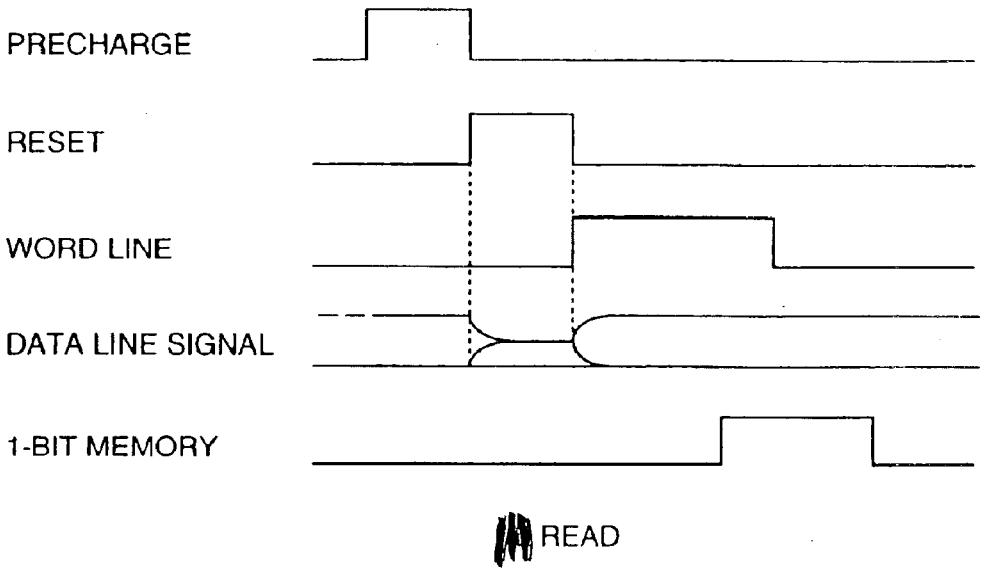
FIGS. 5(*a*) and 5(*b*) are memory cell operation timing charts of reading and writing operations in the first embodiment.
Figure 5B:
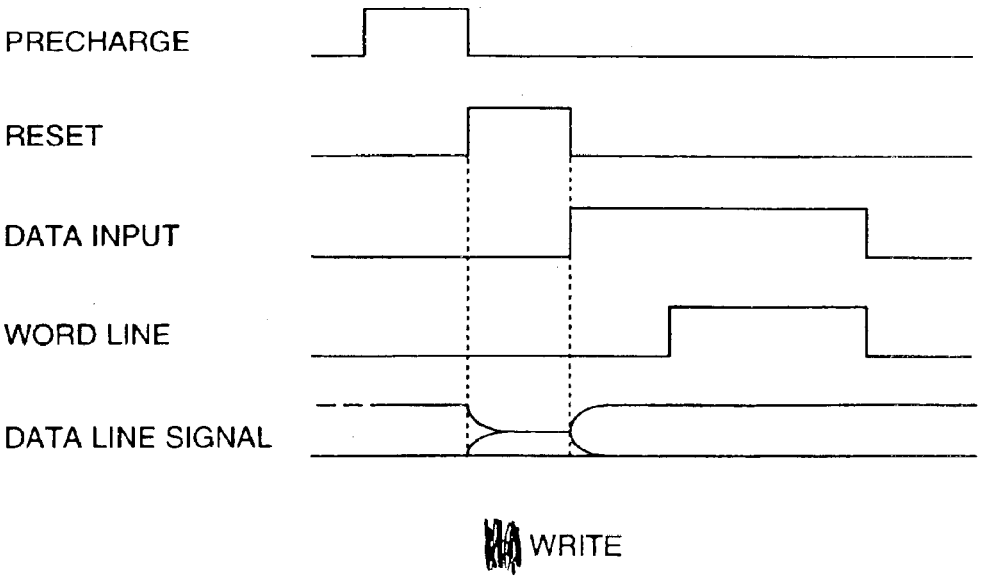

Next, the operation of frame memory 7 will be explained with reference to FIGS. 5(*a*) and 5(*b*), which are the timing charts showing the writing of data to the memory cell and the reading of data from the memory cell, respectively. Here, the upper signal level in the figure represents the high voltage output, that is, the on-state, and the lower signal level in the figure represents the low voltage output, that is, the off-state.

First of all, in the reading operation, data line reset switch 38 and inverse data line reset switch 39 precharges data line 26 and inverse data line 27 at the low voltage level and the high voltage level, respectively. Then, data line 26 and inverse data line 27 are reset to the middle value between the low voltage level and the high voltage level as shown in FIG. 5(*a*). Next, when word line 22 selected by word line shift register 24 is turned on, the data stored in selected memory cell 21 is read to data line 26 and inverse data line 27 as signal voltages which conflict with each other. Then, the data stored in memory cell 21 can be read to a one bit memory composed of data line latch 35, inverter 36, and data line latch 37 by turning on or turning off data line latch 35 and data line latch 36.

Next, the case where the content of the memory cell is read to bus 18 through TCON 14 will be explained. At this time, it is similar to the case where data is read to a one bit memory, excluding that word line 22 selected by Y decoder 23 is turned on, and that the data of the address selected by X decoder 31, among the data read to data line 26, is output through data input switch 30, data input line 32, and data output buffer 34.

Next, in the writing operation, data line reset switch 38 and inverse data line reset switch 39 precharges data line 26 and inverse data line 27 at the low voltage level and the high voltage level, respectively. In the subsequent reset, data line short-circuit switch 29 effects a short-circuit of data line 26 and inverse data line 27, and both are reset to the middle value between the low voltage level and the high voltage level, respectively. These operations are similar to the reading operation. Next, when data input switch 30 selected by the X decoder 31 is turned on, the input data input from data input buffer 33 to data input line 32 is input to data line 26 and inverse data line 27. Under such a condition, when word line 22 selected by Y decoder 23 is turned on, the input data input to data line 26 and inverse data line 27 is written in memory cell 21 selected by X decoder 31. At this time, it is clear that the data of memory cell 21 not selected by X decoder 31 does not change as a result of the above-mentioned writing operation.

Next, the configuration and the operation of the low power consumption DA converter 6 will be explained with reference to FIGS. 6 and 7.

Figure 6:
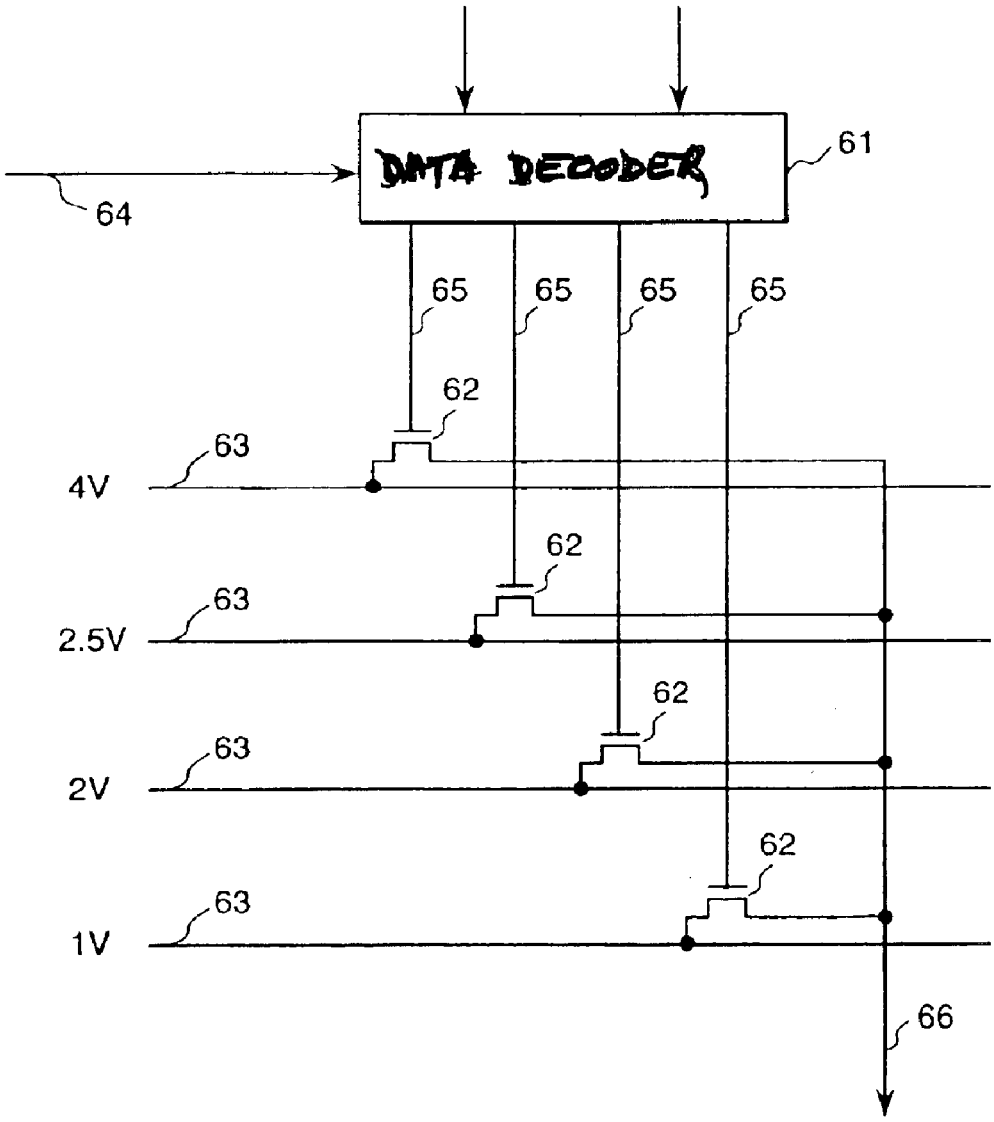
FIG. 6 is a schematic diagram which shows the circuit structure of a DA converter base unit in the first embodiment.

FIG. 6 shows the structure of the base unit of the circuit which corresponds to one column of low power consumption DA converter 6. The data output from the frame memory 7 is input to data decoder 61 every two bits. Four output lines 65 extend from the data decoder 61. Analog voltage selection switch 62 is provided in each output line 65, and one end of analog voltage selection switch 62 is connected to reference voltage line 63. The other end of analog voltage selection switch 62 joins one and forms analog signal line 66. Field inverse signal line 64 is separately input to data decoder 61.

Figure 7:
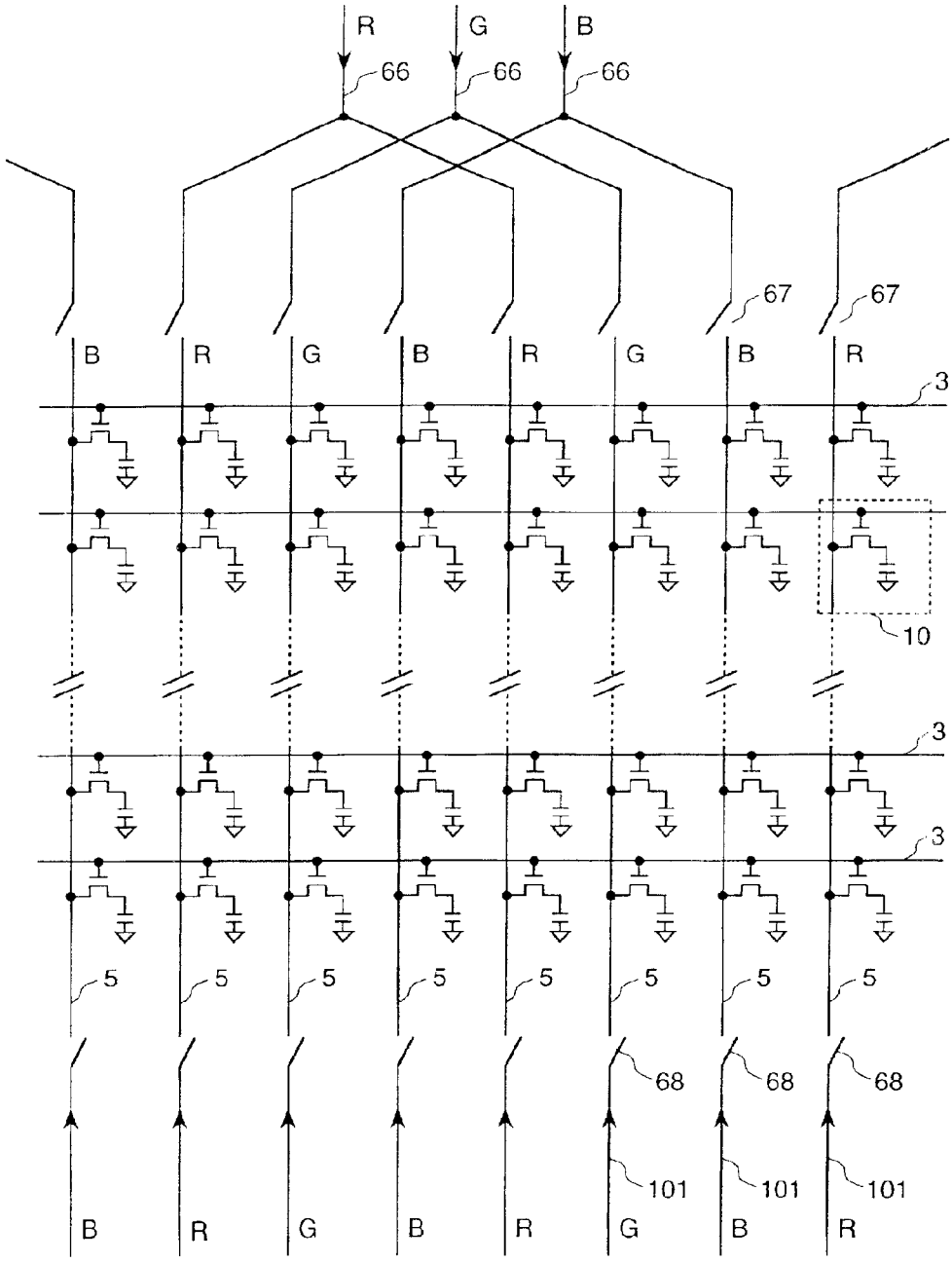
FIG. 7 is a schematic diagram which shows the circuit structure of the analog signal line in the first embodiment to the display pixel matrix.

FIG. 7 shows the configuration between the above-mentioned analog signal line 66 and the display pixel matrix. Although the RGB or 3 color stripe filter is provided to the pixel matrix to display in colors, the colors of the filter are shown as R, G, and B. Analog signal line 66 is branched to two lines, which are connected to the adjacent signal line 5, which has the same color filter through low power consumption DA output switch 67.

Next, the operation of low power consumption DA converter 6 will be explained. The data output from the frame memory 7 represents the image data of one unit or two bits. On the other hand, data decoder 61 performs the decode-processing to four values from two bits, and turns on either of four analog voltage selection switches 62 through an output line 65. As a result, the voltage of reference voltage line 63 that is selected is applied to analog signal line 66. In this embodiment, to decrease the number of reference voltage lines 63, the common electrode of the liquid crystal is driven by alternating current 0/5V between fields. At this time, the output of data decoder 61 should be reversed, for instance, with 4V/1V between the field much the same as black. Data decoder 61 uses field inverse signal line 64 to obtain the polarity information on a liquid crystal common electrode when decoding.

Only half of the number of columns of the display pixel area is provided as for the number of analog signal line 66. In this regard, each analog signal line 66 is branched to two lines, as seen in FIG. 7. The voltage of reference voltage line 63 previously selected is equally input to two adjacent signal lines 5, which have the same color filter through low power consumption DA output switch 67, which is turned on only in the low power consumption display mode. The reduction in the occupation area in frame memory 7 arranged in the image frame of the liquid crystal display panel and the decrease of power consumption are achieved in this embodiment by making the number of pixel data in the column direction, as stored in frame memory 7, equal to half of the number of columns of the display pixel area.

Next, the configuration and the operation of gate line shift register 4 will be explained with reference to FIG. 8, which shows the circuit structure of gate line shift register 4. The outputs of shift register circuit 70 for scanning the gate line one by one are input to an OR circuit 71 every two outputs, and the output of OR circuit 71 is branched and connected to gate line 3 through a two-pole scanning switch 72. Moreover, sequential scanning switch 73, which connects the output of shift register circuit 70 directly to gate line 3, is provided as well.

Shift register circuit 70 selects outputs one by one. However, the gate lines adjacent in the top and bottom are scanned simultaneously every two lines, because two-pole scanning switch 72 is in an on-state and sequential scanning switch 73 is in an off-state, in the low power consumption display mode.

In this embodiment, the number of pixel data in a line direction stored in frame memory 7 can be made equal to half of the number of lines of the display pixel area by writing the same analog signal voltage to the adjoining display pixel of two lines. As a result, a reduction in the occupation area and a decrease of the power consumption in frame memory 7 are realized.

Figure 9:
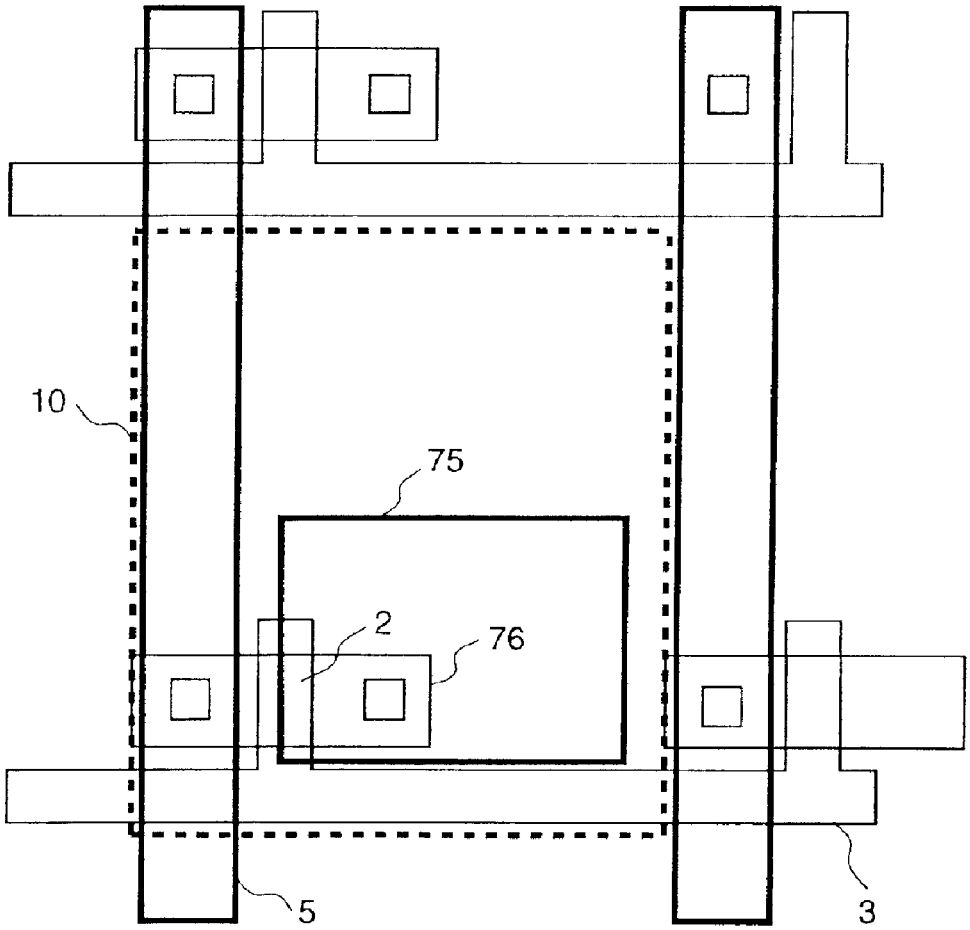
FIG. 9 is a diagram which shows the outline of the layout of the display pixel in the first embodiment.

Next, the configuration and the operation of display pixel 10 will be explained with reference to FIG. 9, which is a layout schematic diagram of display pixel 10. Signal line 5 is provided in a column direction, and gate line 3 is provided in a line direction. Pixel switch 2 using polysilicon thin film 76 is provided in the neighborhood of the intersection of the signal line and the gate line. Moreover, the electrode for the formation of the capacity of the liquid crystal composed of metal electrode 75 and the transparent electrode (not shown for the simplification) is formed in one end of pixel switch 2. The configuration shown in the square is an electric contact here.

When gate line 3 is selected, the voltage applied to signal line 5 is written in the capacity 1 of the liquid crystal, and an optical characteristic of the liquid crystal is modulated, so that the image is displayed. When back light 17 is lit, the light from the back light penetrates the liquid crystal layer through the part where metal electrode 75 is missing. The image is displayed in this case with the apparatus operating as a transmission-type liquid crystal display panel. On the other hand, the incident light from the upper side of the screen can be reflected by metal electrode 75 when the back light 17 is not lit, and the liquid crystal layer passes the reflected light in a similar way. Therefore, the image is displayed with the apparatus operating also as a reflection-type liquid crystal display panel in this embodiment. Although back light 17 is required to be not lit basically when the low power consumption display mode is selected, the reflection-type image display can be performed at the same time by adopting the configuration of such display pixel 10 in this embodiment.

Figure 10:
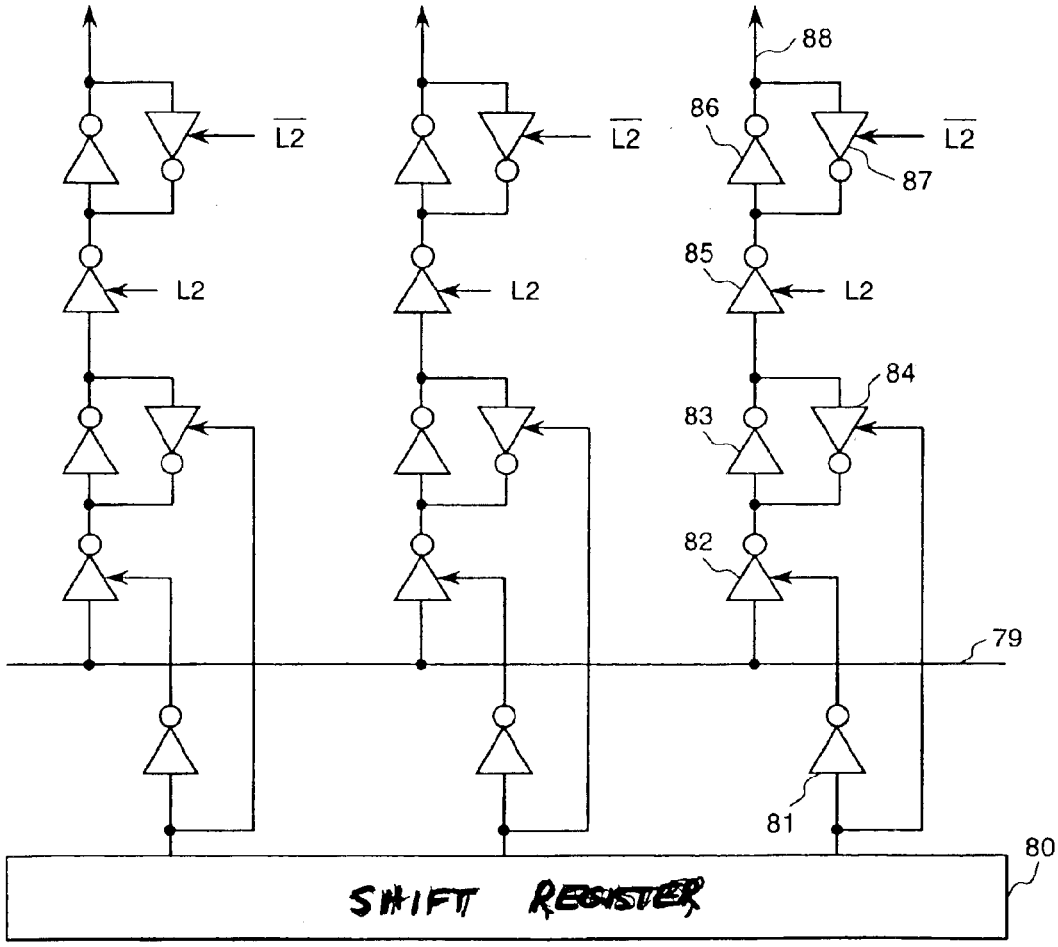
FIG. 10 is a schematic diagram shows the circuit structure of the line memory in the first embodiment.

Next, the configuration and the operation of line memory 12 will be explained with reference to FIG. 10, which shows the circuit structure corresponding to three columns of line memory 12. Data input line 79 carries data from the frame memory 13 is input to the first latch circuit composed of data line latch 82, inverter 83, and data line latch 84. The output of the first latch circuit is connected to data line 88 through a second latch circuit composed of data line latch 85, which operates in response to the latch signal (L2 in Figure), inverter 86, and data line latch 87, which operates in response to the inverse latch signal (L2 bar in Figure). The first latch circuit is controlled by shift register circuit 80 and inverter 81 connected thereto.

The digital display data is input from frame memory 13 through TCON 14 to data input line 79 one by one. In synchronization with this, shift register circuit 80 samples the input digital element data and output this data to a first latch circuit composed of data line latch 82, inverter 83, and data line latch 84. The second latch circuit composed of data line latch 85, inverter 86, and data line latch 87 is driven when the data input for one line is completed, and the data corresponding to one line stored in the group of the first latch circuits is memorized. Then, the first latch circuit begins to sample the following digital display data. The second latch circuit keeps outputting the digital display data latched to data line 88 during this period of time. To simplify the drawing, only the circuit which corresponds to one bit is shown in the Figure, though the digital display data output from the frame memory 13 is composed of 6 bits in this embodiment.

Next, the configuration and the operation of highly accurate DA converter 11 will be explained with reference to FIG. 11, FIG. 12, and FIG. 7.

Figure 11:
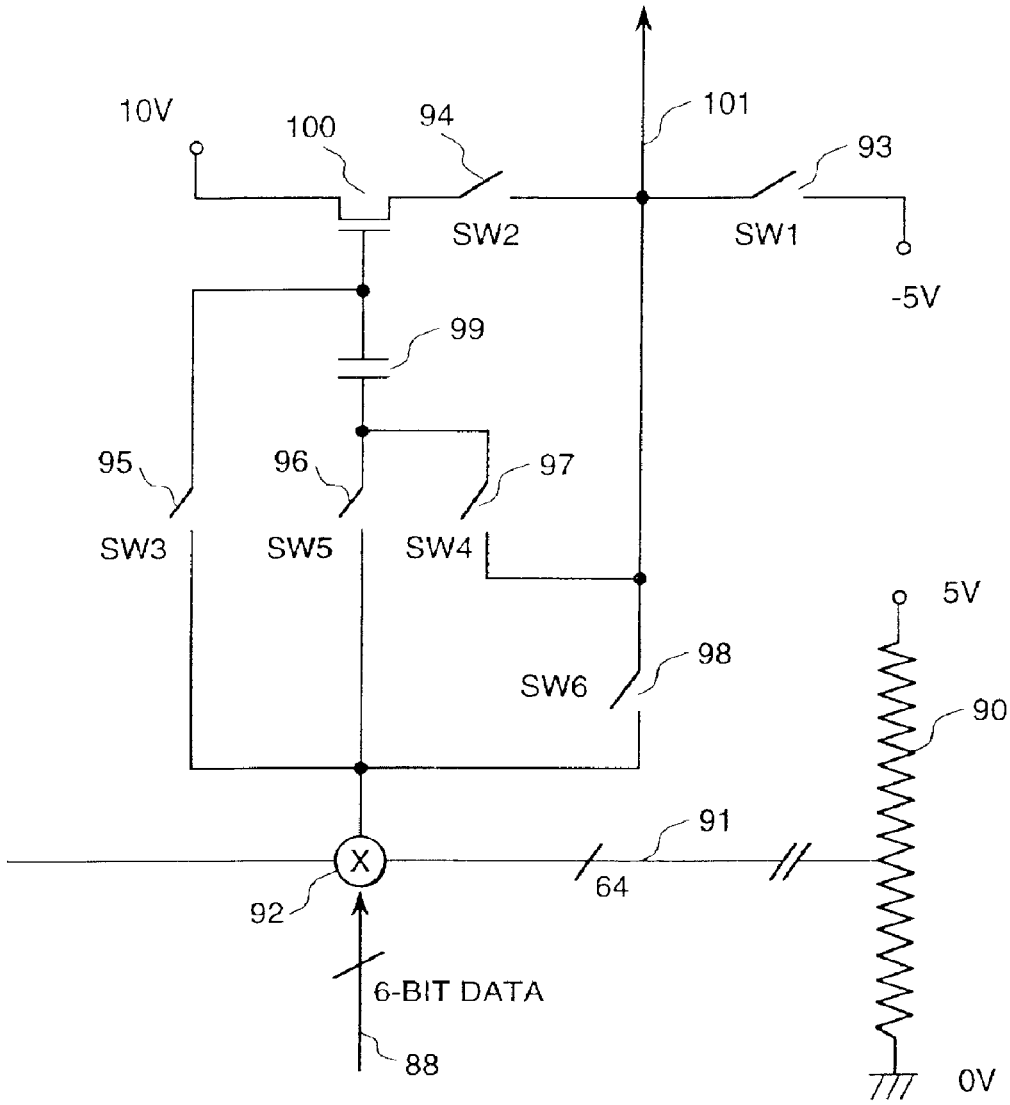
FIG. 11 is a schematic diagram shows the circuit structure of a base unit of the highly accurate DA converter in the first embodiment.
Figure 12:
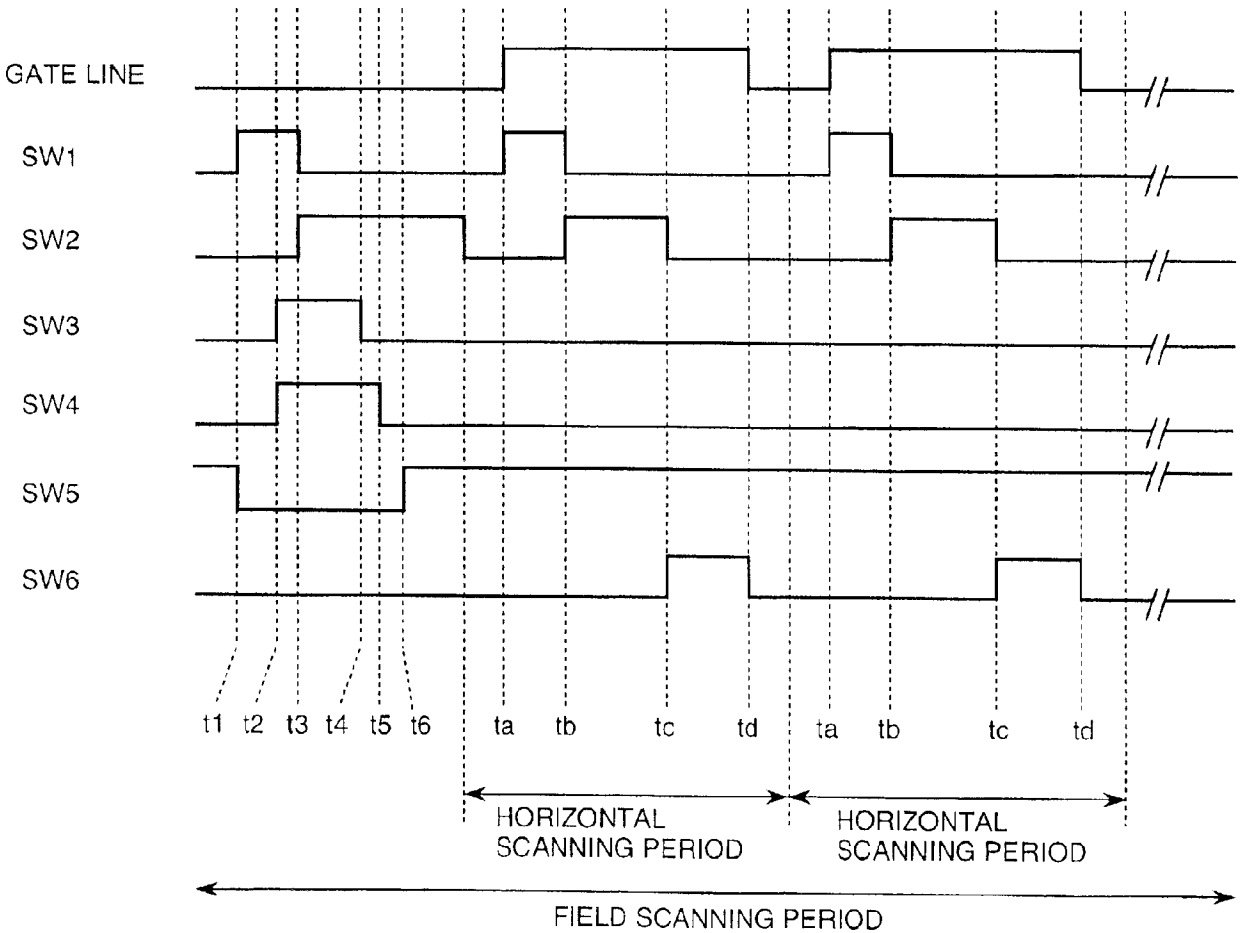
FIG. 12 is an operation timing chart of the highly accurate DA converter in the first embodiment.

FIG. 11 shows the circuit structure of one unit of the highly accurate DA converter 11. Data line 88 from the second above-mentioned latch circuit carries 6 bits of digital data to multiplexer 92. Besides, 64 reference voltage lines 91 extend from the ladder resistance to multiplexer 92.

Multiplexer 92 selects one of the 64 reference voltage lines 91 based on the digital data of six bits, and connects this line to switches SW3 95, SW5 96, and SW6 98. The voltages 0V and 5V are applied at opposite ends of the ladder resistance, and the intermediate voltages are input to 64 reference voltage lines 91. The other end of SW3 95 is connected to the gate of precharge TFT 100 and one end of threshold cancellation capacity 99. The other end of SW5 96 is connected to the other end of the threshold cancellation capacity 99 and one end of SW4 97. The other end of SW6 98 is connected to the other end of SW4 97 and to signal line 101. Moreover, signal line 101 is connected to −5V through SW1 93 and is connected to the source of precharge TFT 100 through SW2 94. High voltage of 10V is applied to the drain of precharge TFT 100 composed of polysilicon.

Next, the operation of highly accurate DA converter 11 will be explained with reference to FIG. 12, in which the operation timing chart of highly accurate DA converter 11 is shown.

First of all, the threshold voltage of precharge TFT 100 is written in the threshold cancellation capacity 99 at the beginning of one field. The output of multiplexer 92 is fixed to the 5V power supply voltage during this period. SW1 is turned on at the period t1–t2, so that the voltage of signal line 101 is reset to −5V. Next, SW3 and SW4 are turned on at the period t2–t3, and both ends of the threshold cancellation capacity 99 are connected. Then, SW1 is turned off at the period t3–t4, and SW2 is turned on. As a result, precharge TFT 100 operates as a source follower, and the voltage of signal line 101 is charged to (5V−Vth). When SW3 is turned off at the period t4–t5 after the charge had been completed, the voltage which corresponds to the threshold Vth of precharge TFT 100 is written in the threshold cancellation capacity 99. Next, after SW4 is turned off, SW5 is turned on at the period t5–t6. As a result, the voltage higher by Vth than the output of multiplexer is input to the gate of the precharge TFT 100.

The horizontal scanning period continuously is begun after the writing of the above-mentioned threshold voltage is completed. The digital display data corresponding to one line stored in line memory 19, is digital-to-analog converted and output from multiplexer 92, and then is written in the display pixel one by one in each horizontal scanning period. First of all, gate line 3 selected by gate line shift register 4 is turned on and SW1 is turned on at the period ta–tb, and the voltage of signal line 101 is reset to −5V. Continuously, SW2 is turned on, and precharge TFT 100 is made to operate as a source follower at the period tb–tc. As a result, signal line 101 is precharged to the analog signal voltage output from multiplexer 92. When SW6 is turned on instead of SW2 at period tc-td after this precharge is completed, multiplexer 92 will write the analog signal voltage directly in signal line 101.

However, because the signal line 100 is substantially already precharged to this analog signal voltage at this time, the data written in signal line 101 at the period tc-td is only a fluctuation correction of the voltage that occurred at precharge. Therefore, the electric current output from multiplexer 92 is extremely small in this embodiment. It is possible to design the value of a resistor to be comparatively large because a substantially direct current to ladder resistor 90 for supplying the electric current to reference voltage line 91 does not flow. As a result, the power consumption which originates in the penetration electric current of the ladder resistance can be adjusted to an extremely small value in this embodiment. Vth of precharge TFT 100 is canceled by using the threshold cancellation capacity 99 in this embodiment, as described above. The purpose is to prevent a charging current corresponding to Vth from flowing to signal line 101 when SW6 is turned on, and the analog signal voltage is written directly from multiplexer 92 in signal line 101. It becomes possible to set ladder resistance 90 for supplying an electric current to reference voltage line 91 to the resistor with larger resistance. As a result, the power consumption in the liquid crystal display panel can be decreased.

The top of signal line 101 shown in FIG. 11 is connected to the bottom of FIG. 7, that is, it is connected to signal line 5 through highly accurate DA output switch 68. This highly accurate DA output switch 68 and low power consumption DA output switch 67 are turned on or turned off according to a high-definition display mode and the low power consumption display mode, respectively, by selecting either highly accurate DA converter 11 or low power consumption DA converter 6.

The number of signal lines 101 and the number of display pixel frames are equal to each other, while the number of analog signal lines 66 is only half the number of columns of display pixel area, as previously described. The reason for this is as follows. That is, although the power consumption and the occupation area of frame memory 7 is reduced by supplying the same signal data voltage to two adjacent signal lines 5, which have the same color filter in the low power consumption display mode, as mentioned above, it is required to supply a different signal data voltage to individual signal lines 5 in a high-definition display mode in order to realize an integration degree that is twice that of the "low power consumption display mode" in the columnwise direction.

In addition, shift register circuit 70 directly scans the gate line 3 by using sequential scanning switch 73 in the high-definition display mode, as described previously, by using the arrangement of FIG. 8 in connection with the gate line shift register 4. As a result, an integration that is twice that of the "low power consumption display mode" can be achieved also in a line direction by setting the horizontal scanning period of the high-definition display mode (one line period) to be one half of that of the low power consumption display mode.

As a result, a quadruple resolution can be achieved in the high-definition display mode, in comparison with the low power consumption mode. The number of pixels in the high-definition display mode corresponds to the QCIF (144 176 pixels) format and the number of pixels in the low power consumption display mode conforms to the CIF (288 352 pixels) format in this embodiment. Further, as described previously, RGB of the image data in the low power consumption display mode consists of two bits, and RGB of the image data in the high-definition display mode consists of six bits. For this reason, the memory capacity of frame memory 13 composed of a DRAM-LSI is designed to be 12 times as great as the memory capacity of frame memory 7 composed of an SRAM by using polysilicon TFT on a glass substrate 19.

In this embodiment, display pixel 10, gate line shift register 4, low power consumption DA converter 6, frame memory 7, highly accurate DA converter 11, and line memory 12, etc. are formed by using the polysilicon TFT elements on glass substrate 19. It may be possible to use transparent insulating materials, such as quartz substrates and plastic substrates, instead of the glass substrate.

It will be appreciated that the configuration in which the conductive type and the voltage relation between the n-type and the p-type TFT is established in an opposite way, and other circuit structures can be used within the range of the spirit of the present invention.

The image data in a low power consumption display mode in this embodiment is composed of 2 bits and the number of pixel data is 144 176 pixels, while the image data in a high-definition display mode is composed of 6 bits and the number of pixel data were assumed to be 288 352 pixels. However, It is needless to say that it is possible to change these values within the range of the spirit of the present invention.

In addition, it is possible to select a driving method in which the number of frames per one second (frame rate) when the low power consumption display mode is selected is fewer than that in the high-definition display mode. Because the reflection-type liquid crystal display mode is applied, and thus the contrast of the display image is comparatively low, when the low power consumption display mode is selected, it is very difficult to see flicker even if the frame rate is decreased. Even if the frame rate in the high-definition display mode is assumed to be 60 Hz, for instance, the frame rate in the low power consumption display mode can be decreased to about 15 Hz. As a result, a basic drive frequency when the low power consumption display mode is selected is decreased, and it becomes possible to achieve lower power consumption.

The scanning function of gate line shift register 4 in the low power consumption display mode and the high-definition display mode was assumed to be switchable to the function for scanning the adjacent gate line in the upper and lower direction every two lines at the same time and the function for scanning individually each gate line by switching the two-pole scanning switch 72 and sequential scanning switch 73. Needless to say, a circuit structure which has a similar function can be adopted in the gate line shift register 4. For instance, when three or more gate lines adjacent in the upper and lower direction are scanned at the same time, individual shift register circuit 70 can be provided in the low power consumption display mode. Futher, shift register circuit 70 can be provided individually for the low power consumption display mode and for a high-definition display mode. In addition, the shift register circuit 70 provided individually can be arranged on the right and left sides of the display pixel matrix without deviating from the spirit of the present invention.

Although the CMOS switch, pixel TFT 12 or n-type TFT switch is adopted for various switch groups in this embodiment, it is possible to use other switch configuration, such as a p-type TFT, etc. Moreover, it also will be appreciated that various layout are applicable within the spirit of the present invention.

To sum up the present invention, the image display apparatus has a display unit 50 composed of plural pixels 10 and a control unit 20 for controlling the display unit 50. In addition, this image display apparatus has a DA converter (low power consumption DA converter 6 and highly accurate DA converter 11) for converting the digital display data into an analog image signal. The DA converter is composed of a first DA converter (low power consumption DA converter) and a second DA converter (highly accurate DA converter 11). When these two DA converters are compared from the point of view of power consumption during operation, the power consumption when the first DA converter is operated becomes smaller than the power consumption when said second DA converter is operated. Either the first DA converter or the second DA converter is operated according to an instruction from control unit 20, and the converted analog image signal is output to display unit 50. The number of display pixels (independent display pixel) corresponding to mutually different digital display data is changed according to the instruction from control unit 20, and the display according to an analog image signal is generated by the display unit 50.

It becomes possible to provide an image display apparatus which can produce a high-definition display at a low power consumption by separating the image to be displayed with high definition from an image that is not required to be displayed with a high definition, as described above. In a broad sense, an image display apparatus which can display an image with a low power consumption can be provided.

Furthermore, gate line shift register 4, which controls the scanning of display unit 50, is connected to display unit 50, and control unit 20 outputs an instruction to gate line shift register 4. In this way, the number of independent display pixels of display unit 50 is changed by gate line shift register 4. This control unit 50 gives the instruction to DA converter (6 or 11) and gate line shift register 4 according to the mode switch instruction 40.

The mode switch instruction for switching the mode has two modes, including a first mode for performing the conversion processing by the first DA converter and a second mode for performing conversion processing by the second DA converter. The pixels 10 of the display unit 50 correspond to the regions enclosed by the plural gate lines 3 and the plural signal lines 4, arranged to intersect the plural gate lines 3. Gate line shift register 4 controls at least two gate lines of plural gate lines at the same timing according to the instruction in the first mode, and the first DA converter can output one converted analog image signal to at least two signal lines.

Furthermore, two memories (frame memories 7 and 13) with different capacity, which corresponds to the first DA converter and the second DA converter, respectively, are arranged in the image display apparatus. However, it will be appreciated that other configurations can be used, in which display unit 50, memory 7 with a smaller capacity of the two memories, DA converter (6, 11), and gate line shift register 4 may be formed on the same substrate, and the memory with smaller capacity may be formed with polysilicon. It will be further appreciated that the configuration may be adopted in which the memory with a smaller capacity corresponds to the first DA converter, and the memory with a larger capacity corresponds to the second DA converter.

The first DA converter 6 and the second DA converter 7 each convert the input signal into an analog image signal with a different number of bits. Also, the first DA converter 6 and the second DA converter 7 each convert the input signal into an analog image signal with different maximum drive frequencies. The first DA converter 6 outputs an analog image signal with binary gradation.

The image display apparatus further has an illumination means (for example, a back light 17) for supplying light to the display unit, and the illumination means supplies light to the display unit 50 in the second mode of operation.

To sum up the present invention from another viewpoint, the image display apparatus includes a display unit 50 composed of plural pixels, and a control unit 20 for controlling the display unit. The image display apparatus further includes a DA converter for converting digital display data into an analog image signal. The DA converter includes a first DA converter (low power consumption DA converter 6) and a second DA converter (high accuracy DA converter 11), and the first DA converter and the second DA converter each convert the input signal into an analog image signal with a different number of bits.

Either one of the first DA converter and the second DA converter converts digital data into an analog image signal in accordance with an instruction from the controller 20. The control unit 20 gives an instruction to either one of said first DA converter and said second DA converter in accordance with the mode switch instruction.

Two memories (frame memory 7 and 13) with different capacity are provided so as to correspond to the first DA converter and the second DA converter of the image display apparatus, respectively. Display unit 50, DA converter (6, 11), and gate line shift register 4 are arranged on the same substrate, and display unit 50 is rectangular, and the first DA converter and the second DA converter are arranged in the top and bottom of the display unit. The memory with small capacity of the above-mentioned two memories is arranged on the substrate, and the memory with small capacity can be formed with polysilicon.

Mode switch instruction 40 designates a first mode, in which the conversion processing is performed by the first DA converter, and a second mode, in which the conversion processing is performed by the second DA converter. The memory with small capacity corresponds to the first DA converter, and the memory with large capacity corresponds to the second DA converter. The display unit 50 changes the number of the independent display pixels of the display unit according to the instruction from the control unit 20, and displays an image according to the analog image signal. The first DA converter outputs an analog image signal with binary gradation.

The image display apparatus has an illumination means (back light 17) for supplying light to the display unit 50. The illumination means supplies light to the display unit 50 in the second mode.

To sum up the present invention from another viewpoint, the image display apparatus has a display unit 50 composed of plural pixels, and a control unit 20 for controlling the display unit. The image display apparatus further has DA converters (low power consumption DA converter 6 and high accuracy DA converter 11) for converting digital display data into an analog image signal. The DA converters include a first DA converter (low power consumption DA converter 6) and a second DA converter (high accuracy DA converter 11). The first DA converter and the second DA converter each convert the input signal into an analog image signal with a different frame frequency.

Either one of the first DA converter and the second DA converter converts digital data into an analog image signal in accordance with an instruction from the controller 20. The control unit 20 gives an instruction to either one of said first DA converter and said second DA converter in accordance with the mode switch instruction. The first DA converter outputs an analog image signal with binary gradation.

The image display apparatus according to the present invention further includes an illumination means (back light 17) for supplying light to the display unit 50. The illumination means supplies light to the display unit 50 in the second mode.

(Second embodiment)

Hereafter, a second embodiment in the present invention will be explained with reference to FIGS. 13–15. Because the main configuration and the operation of the polysilicon TFT liquid crystal display panel according to the second embodiment are similar to that of the first embodiment, an explanation thereof will not be repeated. The difference between the first embodiment and this embodiment lies in the configuration and the operation of the frame memory used in the low power consumption display mode. This feature will be described hereinafter.

Figure 13:
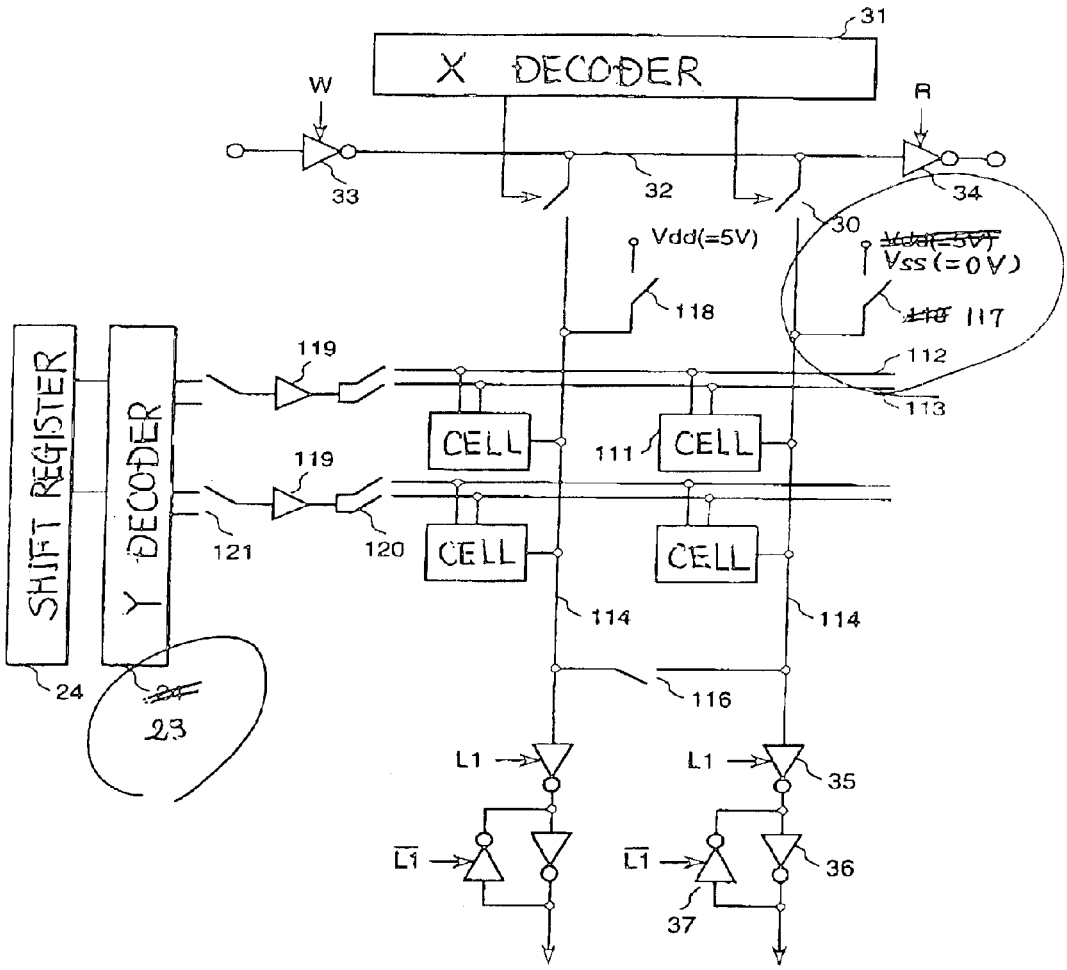
FIG. 13 is a schematic diagram which shows the circuit structure of the frame memory used for "Low power consumption display mode" in a second embodiment.

FIG. 13 shows the configuration of frame memory 7 used in the low power consumption display mode of this embodiment FIG. 13 corresponds to FIG. 2, which illustrates the first embodiment. Word line 112 and latch line 113 are connected in a line direction to SRAM memory cells 111 that are arranged in the form of a matrix. One end of word line 112 and latch line 113 is connected to word line shift register 24 or Y decoder 23, through line drive switch 120, buffer 119, and line selection switch 121. Moreover, memory cell 111 is connected to data line 114 in a column direction.

Data line 114 has two lines, and data line Vdd reset switch 118 or data line Vss reset switch 117 has been provided in respective lines. In addition, data line short-circuit switch 116 is provided between the two lines. Here, Vdd is set to 5V, and Vss is set to 0V. Data input switch 30 has been provided in one end of data line 114. The other end of data input switch 30 is connected to data input line 32. Moreover, data input switch 30 is composed so as to be selected by X decoder 31. Data input buffer 33, which operates in response to the writing signal (W in Figure), and data output buffer 34, which operates in response to the reading signal (R in Figure), are connected to respective ends of data input line 32. On the other hand, a one bit memory composed of data line latch 35, which operates in response to the latch signal (L1 in Figure), inverter 36, and data line latch 37, which operates in response to the inverse latch signal (L1 bar in Figure), is arranged on the other end of data line 114.

Figure 14:
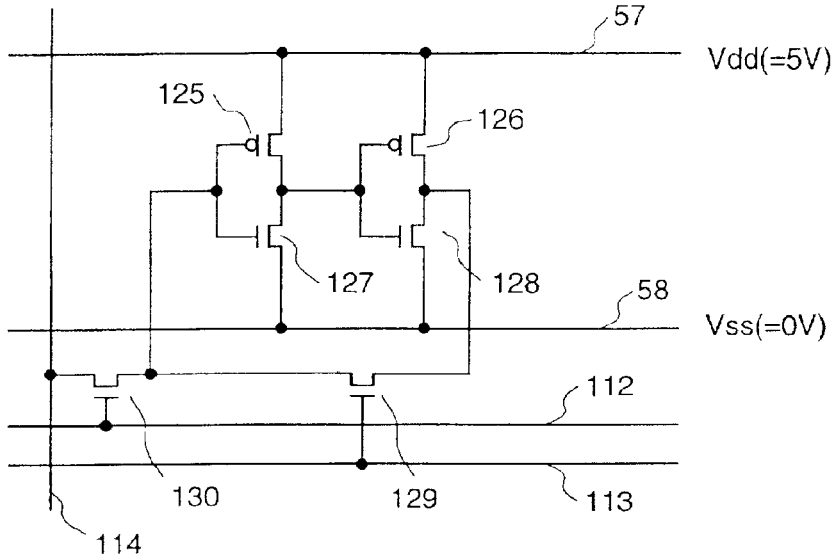
FIG. 14 is a schematic diagram which shows the circuit structure of the SRAM memory cell in the second embodiment FIGS. 15(*a*) and 15(*b*) are memory cell operation timing charts for reading and writing operations in the second embodiment.
Figure 15A:
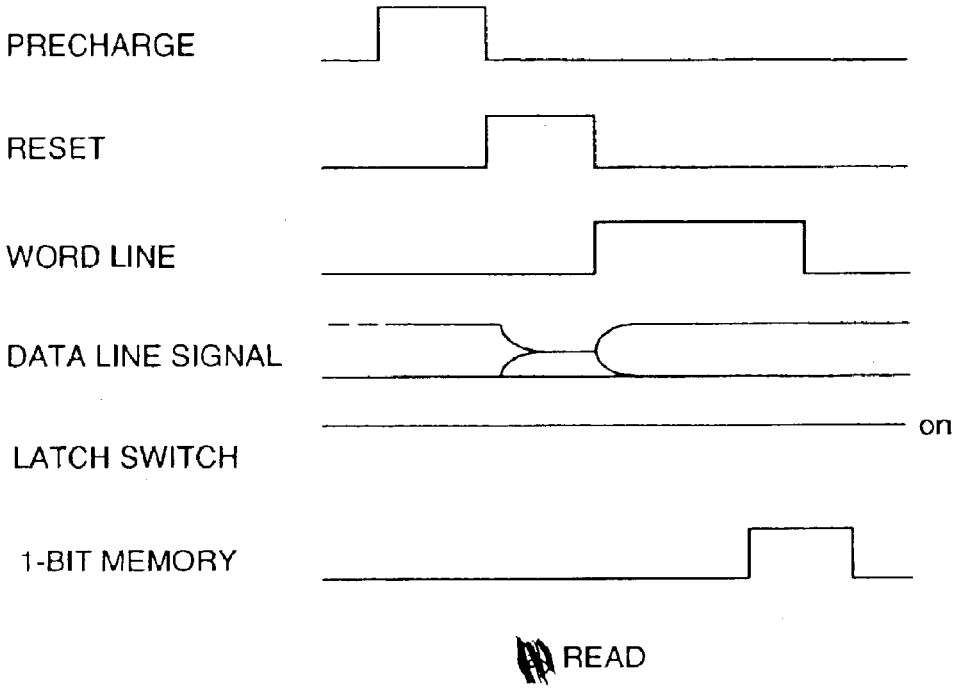
Figure 15B:
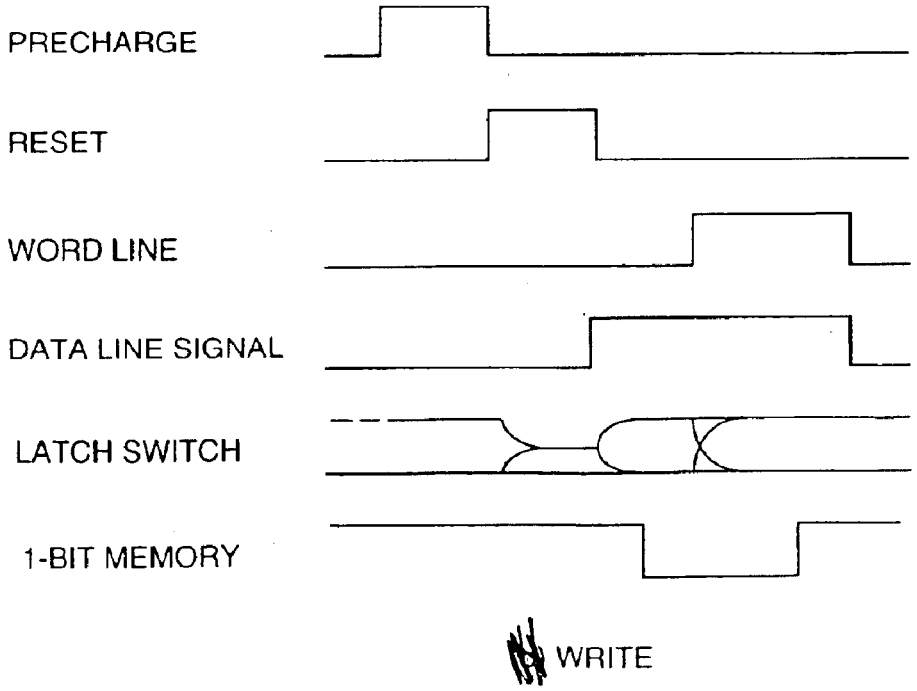

FIG. 14 shows the circuit structure of SRAM memory cell 111. The main body of the memory cell is a flip-flop composed of p-channel polysilicon TFT 125,126 and n-channel polysilicon TFT 127,128. Latch switch 129 controlled in latch line 113 has been inserted in the middle of the flip-flop circuit. This circuit is connected to data line 114 through the word line switch 130 that is controlled by word line 112. The high voltage side of the flip-flop is driven by high voltage power wire 57 to which Vdd=5V is applied, and the low voltage side is driven by low voltage power wire 58 to which Vss=0V is applied.

Next, the operation of the frame memory used in the low power consumption display mode in this embodiment will be explained with reference to FIGS. 15(*a*) and 15(*b*), which are the timing charts showing the reading operation of data from memory cell 111 and the writing operation of data to memory cell 111, respectively. The upper signal level represents the high voltage output, that is, the on-state, and the lower signal level represents the low voltage output, that is, off-state.

First of all, in reading, data line Vdd reset switch 118 and data line Vss reset switch 117 precharge data line 114 to high voltage (5V) and low voltage (0V), respectively. Then, it is reset, and data line short-circuit switch 116 is short-circuited between data lines 114 precharged to high voltage (5V) and low voltage (0V). Data line 114 is reset in the middle value of the low voltage level and the high voltage as shown. Next, when the word line 112 that is selected by word line shift register 24 is turned on through line selection switch 121, buffer 119, and line drive switch 120, the data stored in the selected memory cell 111 is read to data line 114 as a signal voltage. Then, the data stored in memory cell 111 is read to the one bit memory composed of data line latch 35, inverter 36, and data line latch 37 by turning on/turning off data line latch 35 and data line latch 36. At this time, latch switches 129 of all memory cells 111 are always switched to an on-state through all latch lines 113 by buffer 119 and line drive switch 120.

The case where the content of the memory cell is read to bus 18 will be explained. At this time, it is similar to the case where data is read to the one bit memory, except that word line 112 selected by Y decoder 23 is turned on through line selection switch 121, buffer 119, and line drive switch 120, and that the data of the address selected by X decoder 31, among the data read to data line 114, is output through data input switch 30, data input line 32, and data output buffer 34.

Next, also in writing, data line Vdd reset switch 118 and data line Vss reset switch 117 precharge data line 114 to high voltage (5V) and low voltage (0V), respectively. Then, it is reset, and data lines 114 precharged to high voltage (5V) and low voltage (0V) are short-circuited by data line short-circuit switch 116. Therefore, data line 114 is reset to the middle value of the low voltage level and the high voltage level as shown. Next, when word line 112 selected by Y decoder 23 is turned on through line selection switch 121, buffer 119, and line drive switch 120, the data stored in the selected memory cell 111 is read to data line 114 as a signal voltage. These operations are similar to those of reading.

In the writing operation, latch switch 129 of selected memory cell 111 is turned off when latch line 113 selected here with Y decoder 23 is turned off, and the flip-flop function of memory cell 111 is stopped. When data input switch 30 selected by X decoder 31 is turned on, the input data input to data input line 32 from data input buffer 33 is input to the selected data line 114. As a result, the data input to data line 114 is stored in memory cell 111 selected by Y decoder 23 and X decoder 31. At this time, it is clear that the data of memory cell 111 not selected by X decoder 31 is never changed by the above-mentioned writing operation. Then, latch line 113 turns on latch switch 129, the flipflop of memory cell 111 begins to operate, and the selected word line 112 turns off. As a result, a series of writing operations is completed.

According to the present embodiment, it becomes possible always to carry out a stable writing operation even if there is a variation in an individual characteristic of the polysilicon TFT which composes the flip-flop, because the flip-flop circuit is stopped at the time of writing to memory cell 111. As a result, the yield of frame memory 7 is improved.

(Third embodiment)

Hereinafter, a third embodiment according to the present invention will be explained with reference to FIGS. 16 and 17. Because the main configuration and the operation of the polysilicon TFT liquid crystal display apparatus according to the third embodiment are the same as that of the first embodiment, an explanation thereof will not be repeated. The difference between the first embodiment and this embodiment lies in the configuration which uses a front light in place of back light 17 and the configuration of the display pixel. The configuration of the display pixel will be this embodiment is explained hereinafter.

Figure 8:
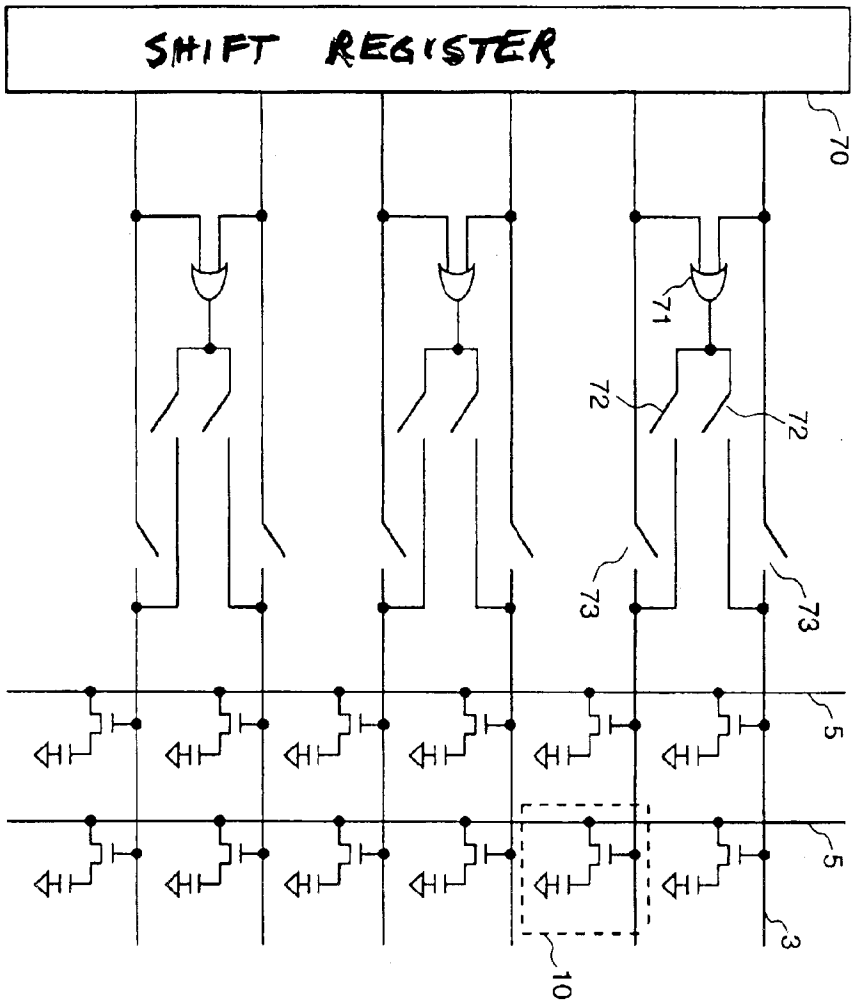
FIG. 8 is a schematic diagram which shows the circuit structure of the gate line shift register in the first embodiment.
Figure 16:
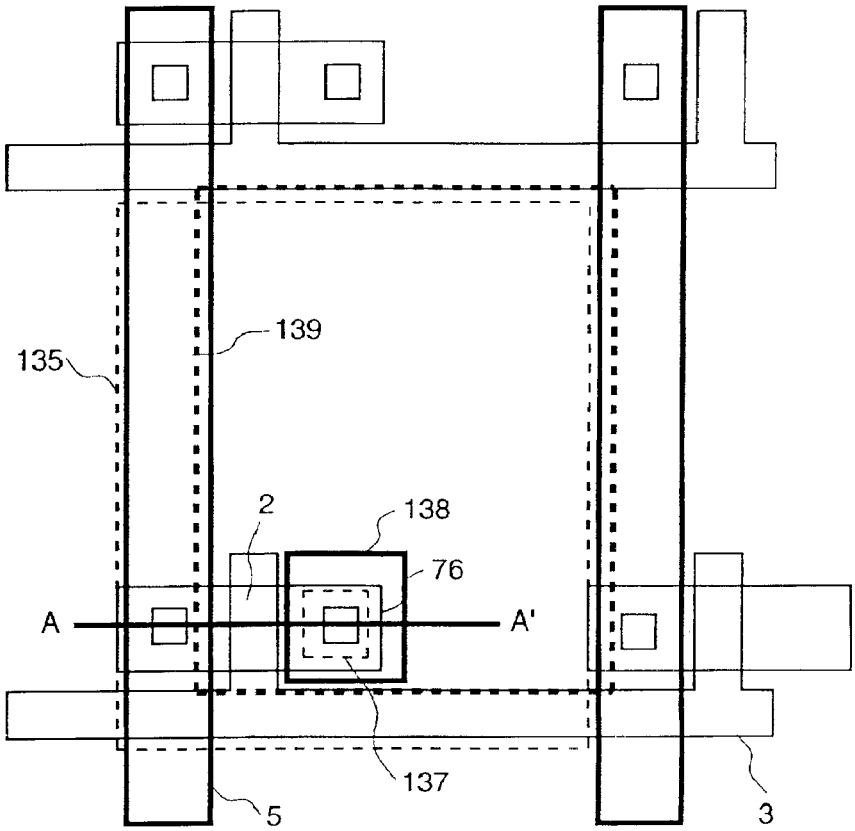
FIG. 16 is a diagram which shows the outline of the layout of the display pixel in a third embodiment.
Figure 17:
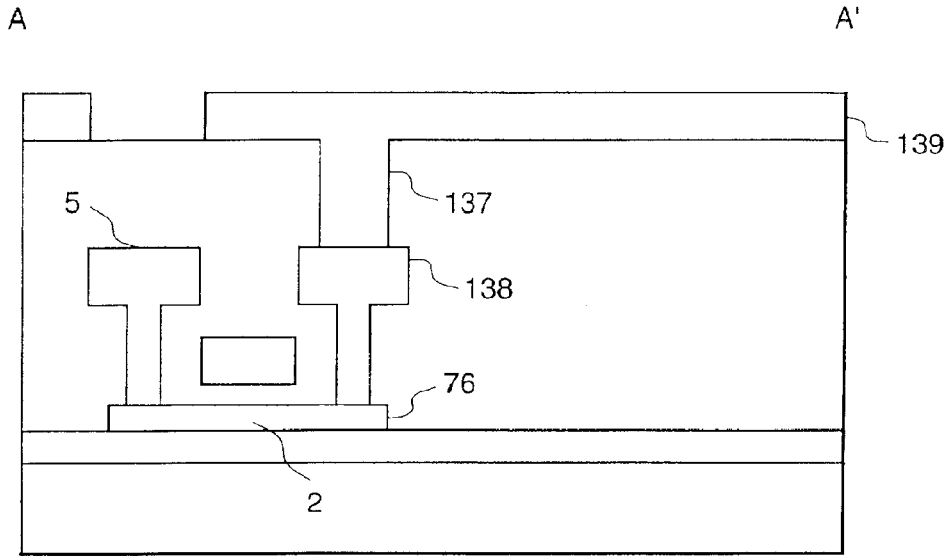
FIG. 17 is a cross-sectional view of a display pixel as seen on line A–A' in FIG. 16.

FIG. 16 is a schematic diagram of the layout of display pixel 135 in the third embodiment, and corresponds to FIG. 8, which relates to the first embodiment. The difference of this embodiment compared with the first embodiment is to further provide reflecting electrode 139 on metal electrode 138 and contact hole 137 for connecting the reflecting electrode 139 and the metal electrode 138. In addition, FIG. 17 shows a sectional view taken along the line A—A' in FIG. 16. The voltage of an analog image signal is applied to reflecting electrode 139 through contact hole 137. That is, reflecting electrode 139 acts as a reflecting plate to the front light, as well as an electrode which forms a part of the capacity of the liquid crystal in the display pixel.

In this embodiment, there is an advantage in that the numerical aperture when illuminating and reflecting can be maintained at about 90% because the front light is used for the illumination to the liquid crystal display. Therefore, the brightness and the contrast of the panel when illuminating and reflecting can be improved.

(Fourth embodiment)

Hereafter, a fourth embodiment of the present invention will be explained with reference to FIG. 18. Because the main configuration and the operation of this embodiment are the same as that of the first embodiment, explanation thereof will not be repeated. The difference of this embodiment compared with the first embodiment concerns the configuration of low power consumption DA converter 6. This configuration will be described.

Figure 18:
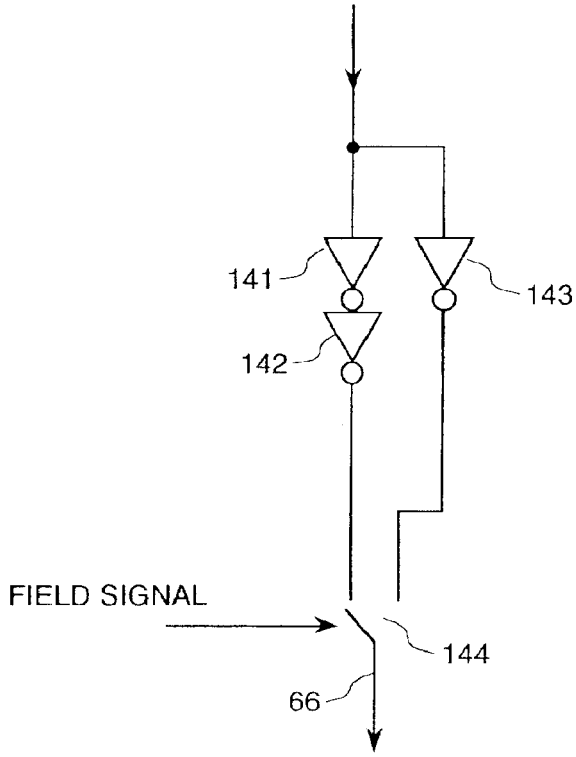
FIG. 18 is a schematic diagram which shows the circuit structure of a DA converter base unit in a fourth embodiment.

FIG. 18 shows the circuit structure of the base unit in the polysilicon TFT liquid crystal display apparatus according to the fourth embodiment of the present invention, in which the base unit corresponds to one column of low power consumption DA converter 6. The data output from the frame memory 7 is input to inverter 141, 142, and inverter 143 for every bit, and the output of both is connected to analog signal line 66 through field-switching switch 144, which is controlled by the field signal.

This low power consumption DA converter 6 operates as a DA converter of the buffer or one bit. The data output from the frame memory 7 shows the display data by one bit. On the other hand, inverter 141,142 and inverter 143 perform the buffer processing from one bit to power supply voltages of 0V or 5V, and apply their output to analog signal line 66. In this embodiment, a common electrode of the liquid crystal is driven to the alternating current of 0/5V between fields. At this time, the output applied to analog signal line 66 must be reversed, for instance, in the same black like 5/0V between the fields.

For that purpose, field-switching switch 144 reverses the output voltage applied to analog signal line 66 between fields by selecting the output of inverter 141,142 or inverter 143.

In this embodiment, it is possible to further decrease the power consumption of the DA converter and the area of occupation of frame memory 7 by having limited the analog image signal input to each display pixel in the low power consumption display mode to one bit (two gradation=eight colors).

(Fifth embodiment)

Figure 19:
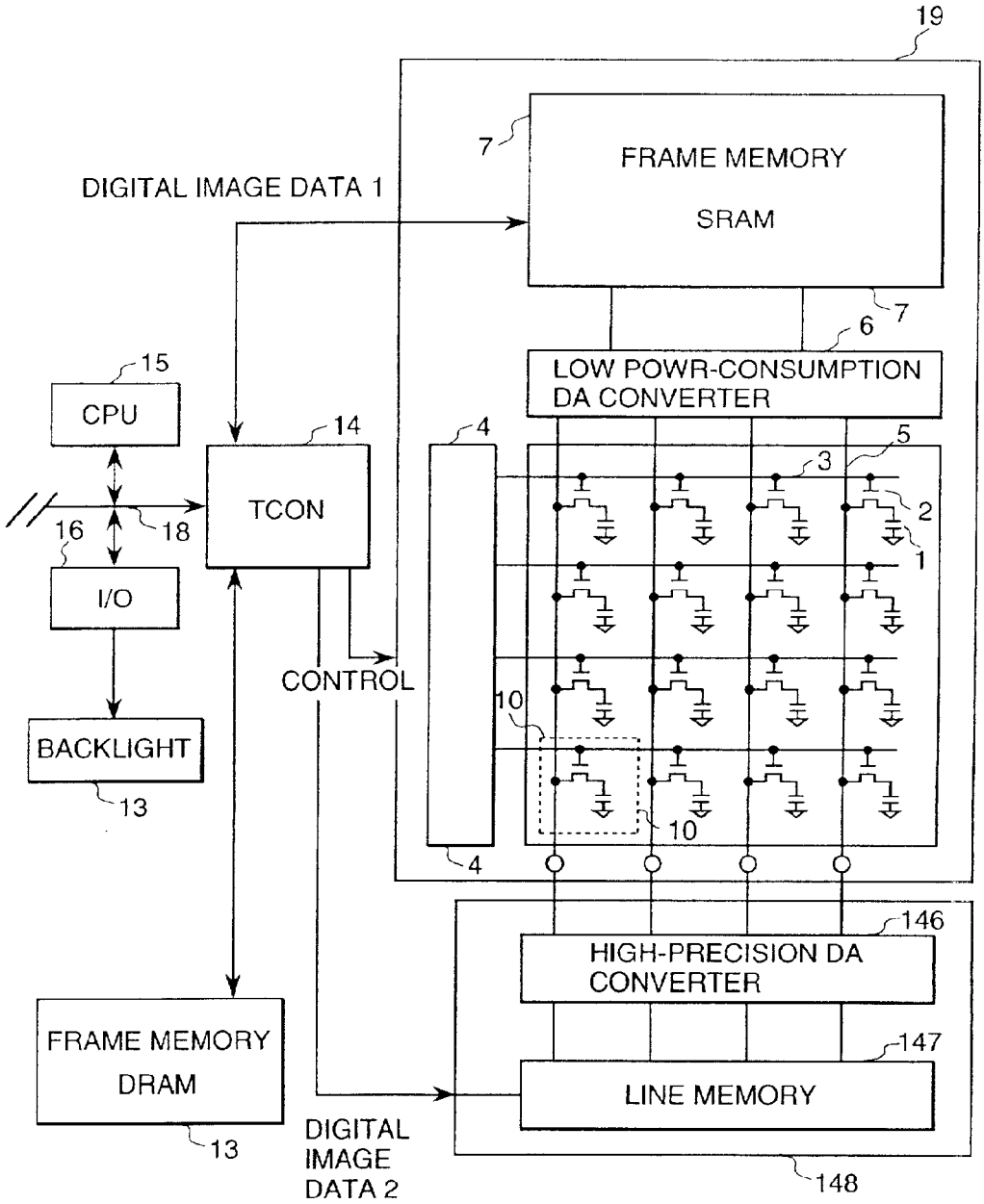
FIG. 19 is a schematic diagram which shows the configuration of a liquid crystal display apparatus according to a fifth embodiment.

Hereafter, a fifth embodiment of the present invention will be explained with reference to FIG. 19, which FIG. 19 shows the configuration of the polysilicon TFT liquid crystal display apparatus. Because the main configuration and the operation of this embodiment are the same as that of the first embodiment, explanation thereof could not be repeated. The difference of this embodiment compared with the first embodiment is that highly accurate DA converter 146 and line memory 147 are composed on a single crystal Si substrate 148 as a LSI. The circuit structure and the operation of highly accurate DA converter 146 and line memory 147 are the same as the first embodiment.

In this embodiment, the area of the driving circuit used in the high-definition display mode is reduced by forming highly accurate DA converter 146 and line memory 147 as a LSI on a single crystal Si substrate 148, and mounting it on a glass substrate 19. Because the shrinkage to the heat process etc. in the single crystal Si substrate 148 compared with glass substrate 19 is remarkably reduced, the suiting accuracy at the process can be excellent, and the area of the circuit made by a minute processing can be decreased.

It is also possible to appropriate the parts which are developed in general as a driver LSI for a-Si TFT, and mass-produced them as they are as a LSI provided on the above-mentioned single crystal Si substrate 148. Moreover, it is also possible to use a highly accurate driver LSI which employs DA converter of eight bits.

(Sixth embodiment)

Figure 20:
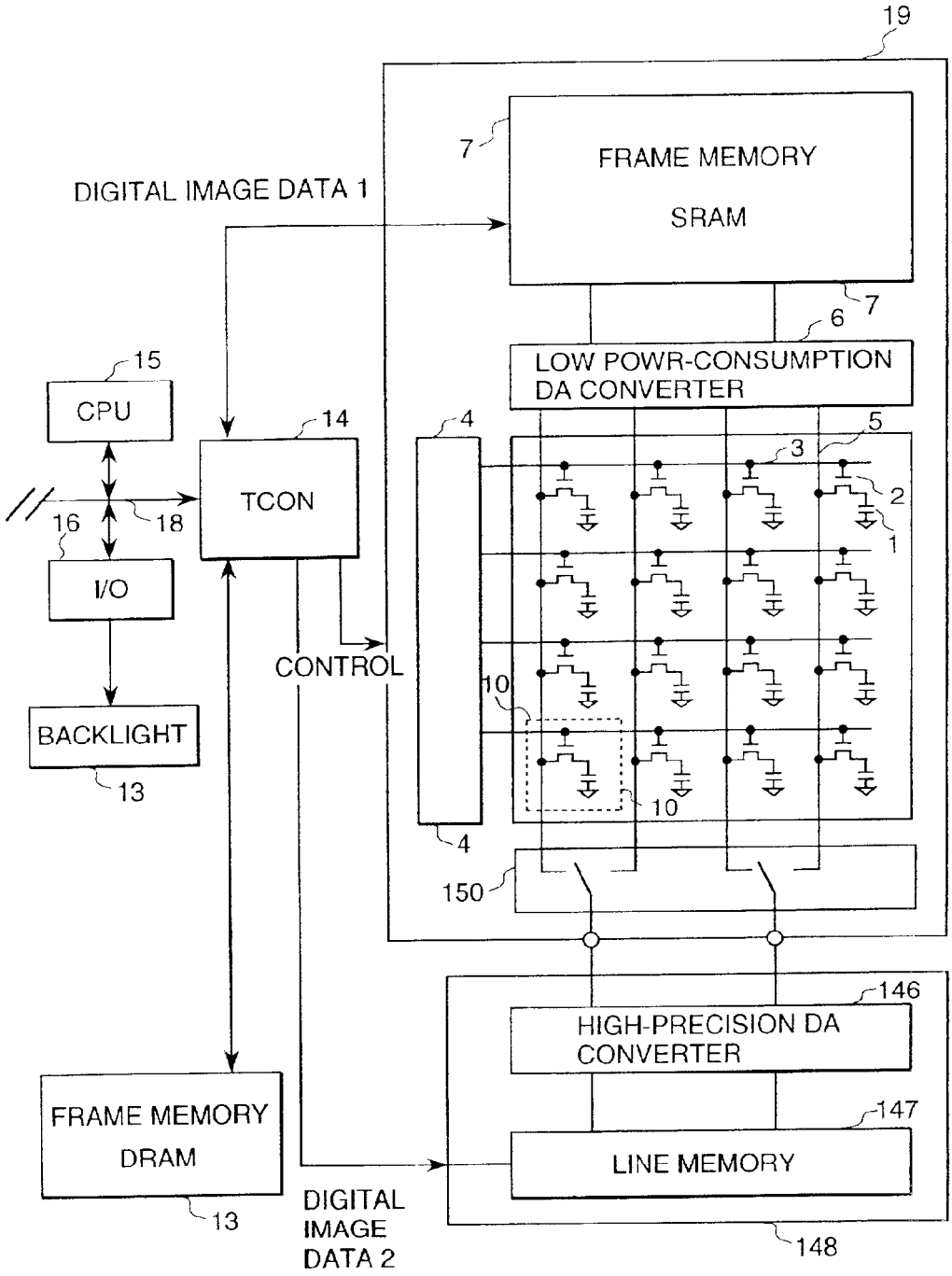
FIG. 20 is a schematic diagram which shows the configuration of a liquid crystal display apparatus according to a sixth embodiment.

Hereafter, a sixth embodiment of the present invention will be explained with reference to FIG. 20, which shows the configuration of the polysilicon TFT liquid crystal display apparatus. Because the main configuration and the operation of this embodiment are the same as that of the fifth embodiment, a detailed explanation thereof will not be repeated. The difference of this embodiment compared with the fifth embodiment is to connect the output of highly accurate DA converter 146 provided in a single crystal Si substrate 148 to signal line 5 through signal line selection switch 150 without connecting it directly to the signal line.

Signal line selection switch 150 is provided on glass substrate 19 by using the polysilicon TFT circuit and has the role of distributing the analog image signal input from highly accurate DA converter 146 to plural signal lines 5 one by one in one horizontal display period.

In this embodiment, it is possible to decrease the number of wiring nodes to the glass substrate 19 of the single crystal Si substrate 148 by providing signal line selection switch 150. Because signal line selection switch 150 operates to select two signal lines in this embodiment, the number of above-mentioned wiring nodes is cut in half compared with that of the fifth embodiment. Thus, it is clear that the number of above-mentioned wiring nodes becomes about 1/n of the number of the signal lines if the number of signal lines selected by selection switch 150 is n (n is a natural number below the number of the signal line).

(Seventh embodiment)

Figure 21:
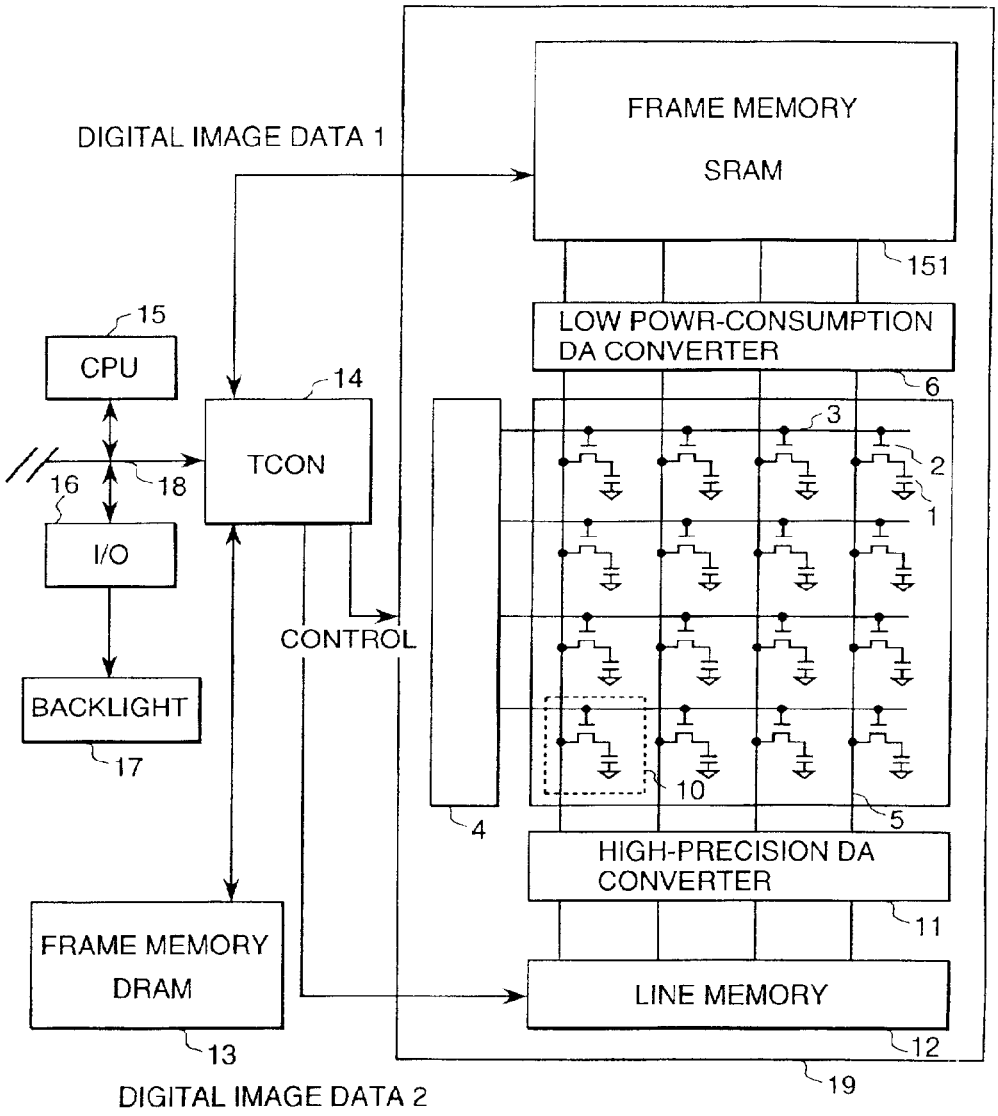
FIG. 21 is a schematic diagram which shows the configuration of a liquid crystal display apparatus according to a seventh embodiment.

Hereafter, a seventh embodiment of the present invention will be explained with reference to FIG. 21, which shows the configuration of the polysilicon TFT liquid crystal display apparatus. Because the main configuration and the operation of this embodiment are the same as that of the first embodiment, a detailed explanation thereof will not be repeated. The structural difference of this embodiment compared with the first embodiment is to use frame memory 151, which uses a DRAM, in place of frame memory 7, which uses a SRAM.

Although the operation of this embodiment is also basically similar to the first embodiment, the DRAM cell in frame memory 151 is refreshed at the same time when the display data of 60 display pixel per one second from frame memory 151 display is written.

The size of glass substrate 19 can be made smaller by simplifying the area of the cell of frame memory 151 by using the DRAM cell as a frame memory in this embodiment, thereby reducing the area of the frame memory. It is also clear that the configuration in which frame memory 13 is a SRAM besides this can be adopted though frame memory 7 is especially assumed to be a DRAM configuration in this embodiment (Eighth embodiment)

Figure 22:
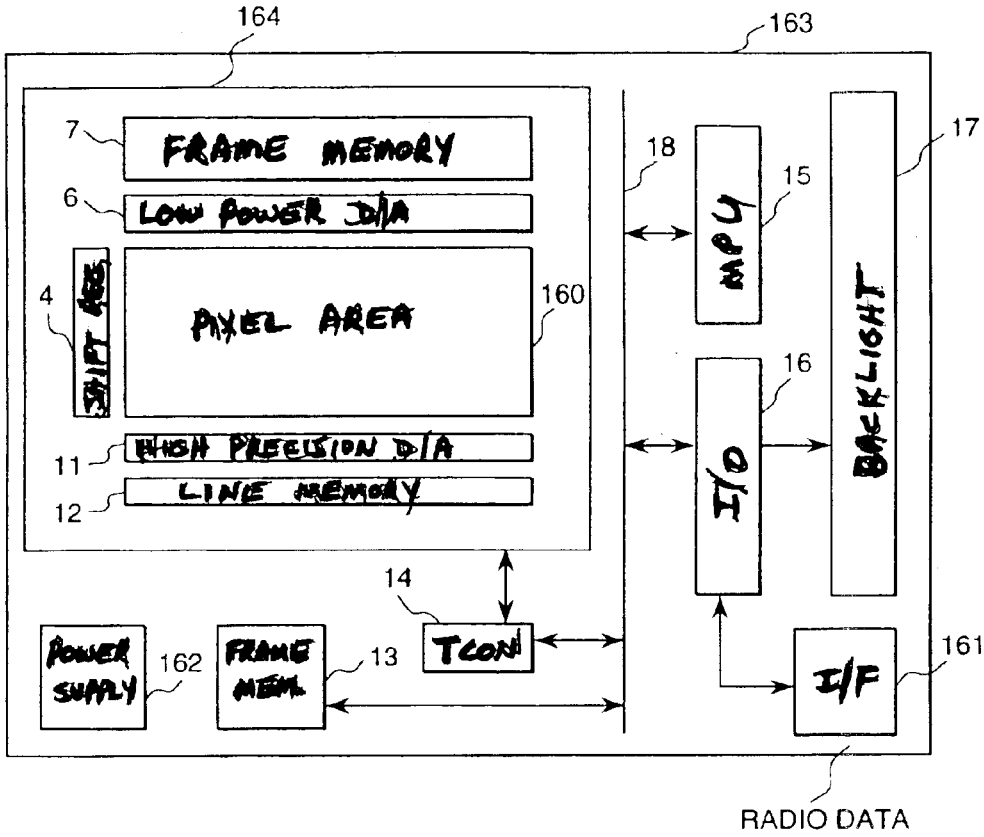
FIG. 22 is a block diagram which shows the configuration of the image display terminal according to an eighth embodiment.

An eighth embodiment of the present invention will be explained with reference to FIG. 22, which shows the configuration of image display terminal 163 according to the eighth embodiment.

The compressed image data is input from the outside to wireless interface (I/F) circuit 161 as radio data based on the bluetooth standard, and the output of wireless I/F circuit 161 is connected to bus 18 through I/O circuit 16. In addition, CPU15, TCON14, and frame memory 13, etc. are connected to bus 18. Further, the output of TCON14 is input to polysilicon TFT liquid crystal display apparatus 164, which has frame memory 7, low power consumption DA converter 6, gate line shift register 4, display pixel matrix 160, highly accurate DA converter 11, and line memory 12. In addition, power supply 162 and back light 17 are provided in the image display terminal 163. Back light 17 is controlled by the I/O circuit 16. Because the internal configuration and the operation of the polysilicon TFT liquid crystal display apparatus 164 is the same as the first embodiment, a detailed description thereof will not be repeated.

The operation of the eighth embodiment will be explained hereinafter. First, I/F circuit 161 fetches the compressed image data from the outside and transmits this image data to CPU15 and frame memory 13 through I/O circuit 16. CPU15 receives the operation from the user and drives image display terminal 163 or performs the decoding processing of the compressed image data, if necessary. The image data decoded is temporarily accumulated in frame memory 13. When a high-definition display mode is selected, the image data is input from frame memory 13 to polysilicon TFT liquid crystal display panel 164 through TCON 14, and display pixel matrix 160 displays the input image in the frame memory one by one for every one line according to the instruction of the CPU 15. At this time, TCON14 outputs a fixed timing pulse necessary to display the image at the same time. As has been described with reference to the first embodiment, polysilicon TFT liquid crystal display apparatus 164 displays the image in display pixel array 160 by using these signals. At this time, I/O circuit 16 lights back light 17, if necessary. The secondary cell for supplying the electric power to the entire device is included in power supply 162 here.

Next, the power supply in the predetermined circuit parts, such as frame memory 13, line memories 12, and highly accurate DA converter 11, is intercepted and the power consumption is reduced, after sending fixed image data from frame memory 13 to frame memory 7 through TCON 14 according to the instruction of CPU 15 when the low power consumption display mode is selected. As described with reference to the first embodiment, polysilicon TFT liquid crystal display panel 164 uses the digital display data written in frame memory 7 at this time and displays the image in display pixel matrix 160. At this time, I/O circuit 16 turns off back light 17 as a rule. Moreover, the amount of the fixed data is reduced according to an instruction from CPU 15 when the image data is transfered from the frame memory 13 to frame memory 7, because the memory capacity of frame memory 7 is remarkably small compared with that of frame memory 13.

According to the eighth embodiment, it is possible to provide an image display terminal in which a high-quality image display and low power consumption are obtained at the same time based on the compressed image data.

(Ninth embodiment)

Figure 24:
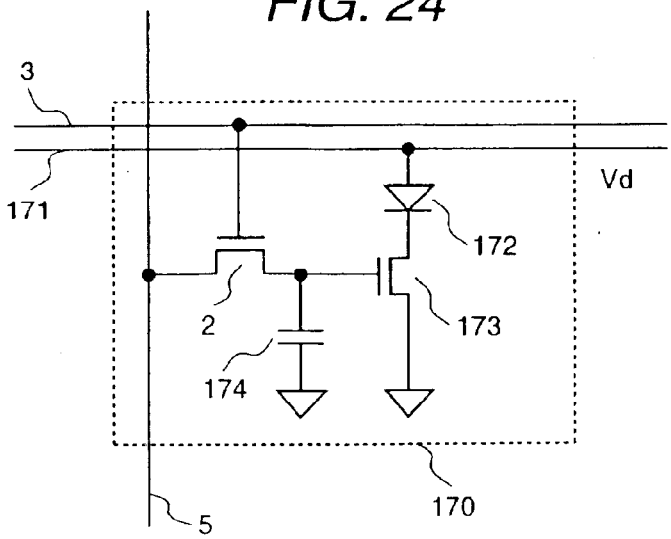
Figure 23:
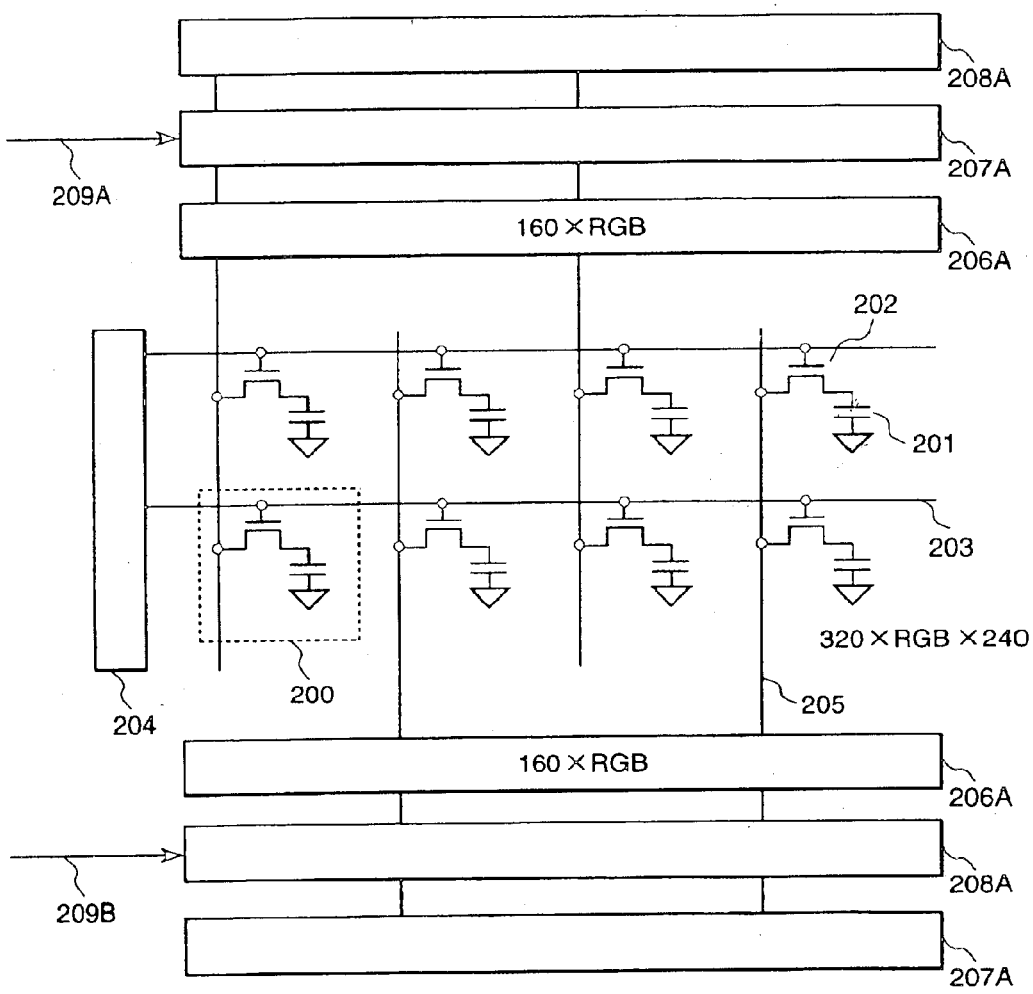
FIG. 23 (PRIOR ART)
FIG. 23 is a schematic diagram which shows the configuration of a conventional liquid crystal display apparatus FIG. 24 a circuit diagram which shows the pixel configuration of an image display unit according to a ninth embodiment.

A ninth embodiment of the present invention will be explained with reference to FIG. 24, which shows the pixel configuration of the image display unit according to the ninth embodiment. Because the main configuration and the operation of this embodiment are the same as that of the first embodiment, a detailed explanation thereof will not be repeated. The structural difference of this embodiment compared with the first embodiment is that an electroluminescence effect (hereafter referred to as EL) display cell is used in place of the liquid crystal display cell, as a configuration of pixel 170. Display pixel 170 has a pixel capacity 174 and pixel switch 2. The gate of pixel switch 2 is connected to gate line 3, and one end of pixel switch 2 is connected to signal line 5. This configuration is similar to that of pixel 10 in the first embodiment. However, in this embodiment, pixel switch 2 and the pixel capacity 174 are connected to the gate of current drive TFT 173 as it is and the drain side of current drive TFT173 is connected to fixed voltage line 171, where fixed voltage Vd was applied through EL diode 172.

The operation of the pixel part of this embodiment will be explained. The analog signal voltage applied to signal line 5 is written in pixel capacity 174 through pixel switch 2 when gate line 3 is selected and turned on. In the same operation as that of the first embodiment, the analog signal voltage written is maintained in the pixel capacity 174 after pixel switch 2 becomes off-state again by gate line 3. However, the driving current corresponding to the value of the above-mentioned analog signal voltage flows to EL diode 172 in this embodiment because the above-mentioned analog signal voltage is input to the gate of current drive TFT 173. And, because by this drive current, EL diode 172 emits light with the brightness which corresponds to the above-mentioned analog signal voltage, this embodiment can display a glow spontaneously in response to the analog signal voltage applied to signal line 5.

According to this embodiment, a high-quality image display and low power consumption in the driving circuit of the signal line 5 are obtained at the same time, similar to the other embodiments.

It is needless to say that the liquid crystal layer and the back light described with reference to the first embodiment are unnecessary, because this embodiment is a spontaneous glow type of display unit, and there is no necessity to drive the analog signal voltage input to the pixel ac because no liquid crystal is present.

What is claimed is:

1. An image display apparatus having a display unit comprised of a plurality of pixels and a control unit for controlling the display unit, further comprising:

a DA converter to convert the digital display data into an analog image signal, wherein said DA converter is comprised of a first DA converter and a second DA converter, each of the first and second DA converters being connected to said display unit separately from one another so that said first DA converter and said second DA converter can respectively supply an output to the display unit independently of one another, power consumption when said first DA converter is operated being smaller than that when said second DA converter is operated, wherein said DA converter operates one of said first DA converter and said second DA converter according to the instruction from said control unit, and outputs the converted analog image signal from said one of said first and second DA converters to said display unit independently of the other of the first and the second DA converters, and wherein said display unit changes the number of the independent display pixels of said display unit according to the instruction from said control unit, and displays according to said analog image signal.

2. A image display apparatus according to claim 1, wherein a gate line shift register to control the scanning of the display unit is connected to said display unit, said control unit outputs the instruction to said gate line shift register, and the number of independent display pixels of said display unit is changed by the gate line shift register, and a image is displayed.

3. A image display apparatus according to claim 2, wherein said control unit gives an instruction to said DA converter end the gate line shift register according to a mode switch instruction.

4. A image display apparatus according to claim 3, wherein said mode switch instruction has a first mode for carrying out the conversion processing by said first DA converter and a second mode for carrying out the conversion processing by said second DA converter, a pixel of said display unit is arranged corresponding to the region enclosed by plural gate lines and plural signal lines arranged to intersect with the plural gate lines, the gate line shift register controls at least two gate lines of said plural gate lines at the same timing in said first mode, and said first DA converter outputs one converted analog image signal to at least two signal lines.

5. A image display apparatus according to either one of claims 1 to 3, further comprising two memories each having different capacity, wherein the two memories correspond to said first DA converter and said second DA converter, respectively.

6. A image display apparatus according to claim 5, wherein said display unit, said DA converter, said gate line shift register, and the memory having small capacity among said memories are arranged on the same substrate, and the memory with small capacity is formed by using polysilicon.

7. A image display apparatus according to claim 6, wherein said memory with small capacity corresponds to said first DA converter, and the memory with large capacity corresponds to said second DA converter.

8. A image display apparatus according to either one of claims 1 to 4, 6 and 7, wherein said first DA converter and said second DA converter each convert the input signal into an analog image signal with different number of bit, respectively.

9. A image display apparatus according to either one of claims 1 to 4, 6 and 7, wherein said first DA converter and said second DA converter each convert the input signal into an analog image signal with different maximum drive frequency, respectively.

10. A image display apparatus according to either one of claims 1 to 4 and 6 to 9, wherein said first DA converter outputs an analog image signal with binary gradation.

11. A image display apparatus according to either one of claims 1 to 4 and 6 to 10, further comprising an illumination means for supplying light to said display unit, wherein the illumination means supplies light to said display unit in a second mode.

12. A image display apparatus comprising:

a display unit comprised of plural pixels;

a control unit to control the display unit;

the image display apparatus further comprising a DA converter to convert digital display data into an analog image signal, wherein said DA converter includes a first DA converter and a second DA converter, each of the first and second DA converter being connected to said display unit separately from one another so that said first DA converter and said second DA converter can respectively supply an output to the display unit independently of one another, and wherein said first DA converter and said second DA converter each convert the input signal into an analog image signal with different numbers of bits, respectively.

13. A image display apparatus according to claim 12, wherein either one of said first DA converter and said second DA converter converts digital data into an analog image signal in accordance with an instruction from said controller.

14. A image display apparatus according to claim 13, wherein said control unit gives an instruction to either one of said first DA converter and said second DA converter in accordance with a mode switch instruction.

15. A image display apparatus according to either one of claims 13 and 14, wherein said display unit changes the number of the independent display pixels of said display unit according to the instruction from said control, and displays according to said analog image signal.

16. A image display apparatus according to either one of claims 12 to 14, further comprising two memories each having different capacity, wherein the two memories correspond to said first DA converter and said second DA converter, respectively.

17. A image display apparatus according to claim 16, wherein the memory with small capacity of said two memories is arranged on the said substrate, and the memory with small capacity is formed with polysilicon.

18. A image display apparatus according to claim 16, wherein said mode switch instruction has a first mode for carrying out the conversion processing by said first DA converter and a second mode for carrying out the conversion processing by said second DA converter, and wherein said memory with small capacity corresponds to said first DA converter, and the memory with large capacity corresponds to said second DA converter.

19. A image display apparatus according to either one of claims 12 to 14, wherein said display unit, said DA converter and the gate line shift register are arranged on the same substrate, the shape of said display unit is rectangular, and the first DA converter and the second DA converter of said DA converters are arranged in the top and bottom of said display unit.

20. A image display apparatus according to any one of claims 12 to 14, wherein said first DA converter outputs an analog image signal with binary gradation.

21. A image display apparatus according to any one of claims 12 to 14, further comprising an illumination means for supplying light to said display unit, wherein the illumination means supplies light to said display unit in said second mode.

22. A image display apparatus comprising:

a display unit comprised of plural pixels;

a control unit to control the display unit;

the image display apparatus further comprising a DA converter to convert digital display data into an analog image signal, wherein said DA converter includes a first DA converter and a second DA converter, each of the first and second DA converters being connected to said display unit separately from one another so that said first DA converter and said second DA converter can respectively supply an output to the display unit independently of one another, and wherein said first DA converter and said second DA converter each convert the input signal into an analog image signal with different frame frequencies, respectively.

23. A image display apparatus according to claim 22, wherein either one of said first DA converter and said second DA converter converts digital data into an analog image signal in accordance with an instruction from said controller.

24. A image display apparatus according to claim 23, wherein said control unit gives an instruction to either one of said first DA converter and said second DA converter in accordance with a mode switch instruction.

25. A image display apparatus according to either one of claims 22 to 24, wherein said first DA converter outputs an analog image signal with binary gradation.

26. A image display apparatus according to either one of claims 22 to 24, further comprising an illumination means for supplying light to said display unit, wherein the illumination means supplies light to said display unit in a second mode.

* * * * *